US006216776B1

(12) United States Patent
Kobayashi et al.

(10) Patent No.: US 6,216,776 B1
(45) Date of Patent: Apr. 17, 2001

(54) HEAT EXCHANGER

(75) Inventors: Osamu Kobayashi, Kariya; Ken Yamamoto, Obu; Yoshiyuki Yamauchi, Chita; Kazuhiro Mitsukawa, Bisai, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/245,826

(22) Filed: Feb. 5, 1999

(30) Foreign Application Priority Data

| | | |
|---|---|---|
| Feb. 16, 1998 | (JP) | 10-032505 |
| Mar. 16, 1998 | (JP) | 10-065719 |
| Apr. 8, 1998 | (JP) | 10-095961 |
| Jun. 16, 1998 | (JP) | 10-168700 |
| Oct. 15, 1998 | (JP) | 10-294163 |

(51) Int. Cl.[7] ..... F28F 9/04; F28F 1/02

(52) U.S. Cl. ..... 165/173; 165/110; 165/174; 165/177

(58) Field of Search ..... 165/140, 173, 165/174, 176, 177, 110

(56) References Cited

U.S. PATENT DOCUMENTS

| | | | | |
|---|---|---|---|---|
| 5,190,101 | * | 3/1993 | Jalelivand et al. | 165/176 |
| 5,236,045 | * | 8/1993 | Janezich et al. | 165/183 |
| 5,479,985 | * | 1/1996 | Yamamoto et al. | 165/176 |
| 5,941,303 | * | 8/1999 | Gowan et al. | 165/176 |

FOREIGN PATENT DOCUMENTS

| | | | | |
|---|---|---|---|---|
| 61-202084 | * | 9/1986 | (JP) | 165/140 |
| 63-3191 | * | 1/1988 | (JP) | 165/176 |
| 1-217195 | * | 8/1989 | (JP) | 165/173 |

* cited by examiner

*Primary Examiner*—Allen Flanigan
(74) *Attorney, Agent, or Firm*—Harness, Dickey & Pierce, PLC

(57) ABSTRACT

A heat exchanger has plural flat tubes through which refrigerant flows, and a pair of header tanks disposed on each longitudinal ends of the flat tubes. Each of the flat tubes has a flow passage portion having plural flow passages through which refrigerant flows, and a non-flow passage portion disposed on both sides of the flow passage portion, having at least one non-flow passage through which no refrigerant flows. The flow passage portion is inserted into the header tank so that the flow passages communicate with the header tank, and the non-flow passage portion is exposed outside the header tank. Each of the flow passages has a circular-shaped cross-section while the non-flow passage has a polygonal-shaped cross-section, so that a wall thickness of the non-flow passage is made thinner than that of the flow passages. Therefore, weight of the flat tube is decreased, while sufficient strength thereof is maintained. On the other hand, the header tank has an inner partition wall for partitioning the header tank into first and second tank passages having an oval-shaped cross-section, so that the header tank has high pressure resistance.

27 Claims, 19 Drawing Sheets

HEAT EXCHANGER

CROSS-REFERENCE TO RELATED APPLICATION

This application relates to and claims priority from Japanese Patent Application No. Hei. 10-32505 filed on Feb. 16, 1998, No. Hei. 10-65719 filed on Mar. 16, 1998, No. Hei. 10-95961 filed on Apr. 8, 1998, No. Hei. 10-168700 filed on Jun. 16, 1998, and No. Hei. 10-294163 filed on Oct. 15, 1998, the contents of which are hereby incorporated by reference.

BACKGROUND OF THE INVENTION

1. Field of the Invention

The present invention relates to a heat exchanger which is typically applied to a condenser or a radiator for a refrigerant cycle in which carbon dioxide is used as refrigerant.

2. Related Art

Recently, refrigerant cycles without using chlorofluorocarbon (hereinafter referred to as flon) as refrigerant are developed to prevent global warming. A super critical refrigerant cycle in which carbon dioxide ($CO_2$) is used as refrigerant (hereinafter referred to as $CO_2$ refrigerant cycle) is studied. However, because the $CO_2$ refrigerant cycle has a high operation internal pressure, heat exchangers used in the $CO_2$ refrigerant cycle, such as a condenser into which high-pressure refrigerant flows, need to have a high strength. As shown in FIG. 38, JP-A-5-215482 discloses a heat exchanger having plural extruded flat tubes 302. Each of the flat tubes 302 has plural fluid passages 302*a* having a round-shaped cross-section, so that strength of each flat tube 302 is improved. However, since each fluid passage 302*a* has the round-shaped cross-section, a wall thickness of the flat tube 302 becomes thicker as compared with a flat tube having fluid passages with a square-shaped cross-section. As a result, weight of each flat tube 302 is increased. On the other hand, when the flat tube has the fluid passages having the square-shaped cross-section, wall thickness and weight of the flat tube are decreased, but strength of the flat tube is also decreased.

On the other hand, JP-A-2-247498 discloses a heat exchanger in which an inner supporting plate is disposed within a header tank having first and second plates, so that strength of the header tank is enhanced. However, in the heat exchanger, the inner supporting plate and the header tank are connected to each other by an acute angle, and stress tends to be intensively applied to a connection portion between the inner supporting plate and the header tank. As a result, the strength of the heat exchanger may be not resistant to high pressures such as 40 MPa of the $CO_2$ refrigerant cycle.

Further, JP-A-3-260596 discloses a conventional heat exchanger having plural flat tubes 402 through which refrigerant flows, and a pair of substantially cylindrical header tanks 405 connected to both longitudinal ends of the flat tubes 402, as shown in FIG. 39. However, high pressure of the $CO_2$ refrigerant cycle is approximately ten times larger than that of a refrigerant cycle using flon as refrigerant. Therefore, when the conventional heat exchanger is used in the $CO_2$ refrigerant cycle, thickness of the header tank 405 may need to be greatly increased so that the header tank 405 has a sufficient pressure resistance. As a result, size and weight of the header tank 405 may be increased.

SUMMARY OF THE INVENTION

In view of the foregoing problems, it is a first object of the present invention to provide a heat exchanger having relatively light weight and high strength.

It is a second object of the present invention to provide a heat exchanger having large pressure resistance.

It is a third object of the present invention to provide a heat exchanger in which refrigerant is introduced into tubes from each tank passage of a header tank so that heat-exchange performance of the heat exchanger is improved.

It is a fourth object of the present invention to provide a heat exchanger in which an amount of refrigerant introduced into tank passages of the header tank is controlled so that heat-exchange performance of the heat exchanger is improved.

According to the present invention, a heat exchanger includes a plurality of tubes and a header tank disposed on each longitudinal ends of the tubes. Each of the tubes has a first portion having a first wall portion for forming plural first passages through which a fluid flows, and a second portion disposed on each sides of the first portion. The second portion has a second wall portion for forming a second passage in which no fluid flows. Each of longitudinal ends of the second portion is recessed from each of the longitudinal ends of the first portion, and the second wall portion has a wall thickness thinner than that of the first wall portion. Therefore, a cross-sectional area of the second passage is increased, while a cross-sectional area of the second wall portion is decreased. Thus, weight of each tube is decreased while strength of each tube is improved.

Preferably, the first passage of the first portion has a round-shaped cross-section, and the second passage has a polygonal-shaped cross-section. Therefore, each of the tubes has a sufficient strength, while weight thereof is reduced.

More preferably, the header tank has therein an inner partition wall extending in a longitudinal direction of the header tank to partition an inner space of the header tank into first and second tank passages. A width of the inner partition wall in a width direction perpendicular to both of a longitudinal direction of the tubes and the longitudinal direction of the header tank is gradually increased toward inner walls of the header tank, so that the first and second tank passages have an oval-shaped cross-section. As a result, pressure resistance of the header tank is improved.

Further, the first tank passage is provided on an upstream air side of the second tank passage relative to a flow direction of air passing through between the tubes, and an amount of the fluid flowing through the first tank passage is made larger than an amount of the fluid flowing through the second tank passage. As a result, more fluid flows through the tubes at an upstream air side, thereby improving heat-exchange performance of the heat exchanger.

Preferably, the header tank has a first communication hole through which the first and second tank passages communicate with each other, and a second communication hole through which the first tank passage communicates with a pipe for introducing the fluid into the header tank. An opening area of the first communication hole is set to smaller than that of the second communication hole, so that more fluid flows through the first tank passage than the second tank passage. Thus, heat-exchange performance of the heat exchanger can be further improved.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PREFERRED EMBODIMENTS

Preferred embodiments of the present invention will be described hereinafter with reference to the accompanying drawings.

Figure 1:
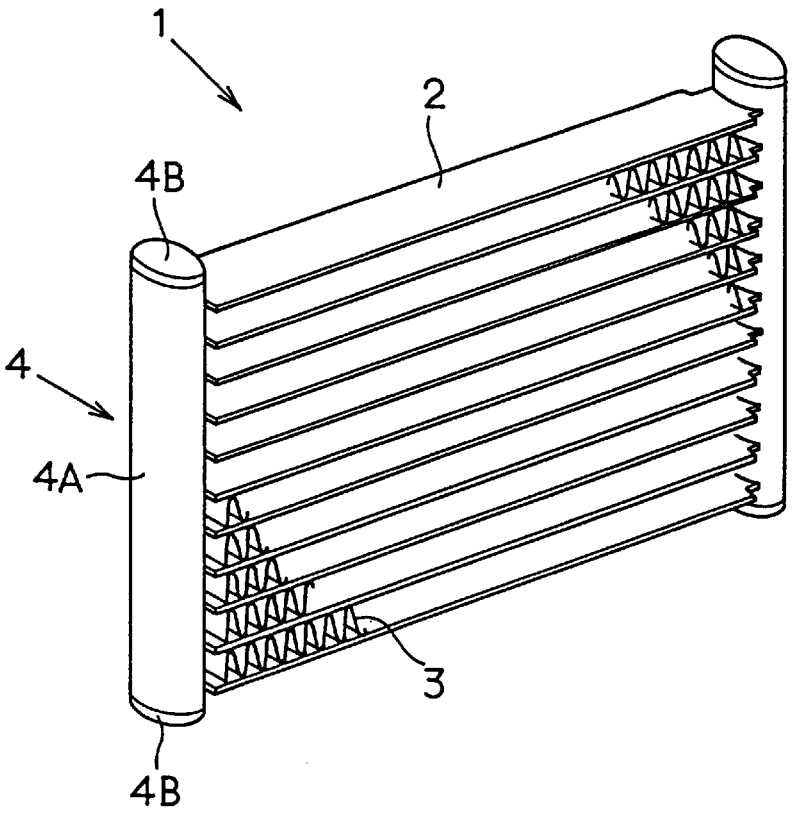
FIG. 1 is a perspective view showing a heat exchanger according to a first preferred embodiment of the present invention.

A first preferred embodiment of the present invention will be described with reference to FIGS. 1–3. In the first embodiment, a heat exchanger 1 shown in FIG. 1 is typically used for a condenser of a refrigerant cycle. As shown in FIG. 1, the heat exchanger 1 has plural flat tubes 2 laminated to each other, corrugated fins 3 disposed between adjacent flat tubes 2, and a pair of header tanks 4 connected to both end of each flat tube 2.

Figure 2A:
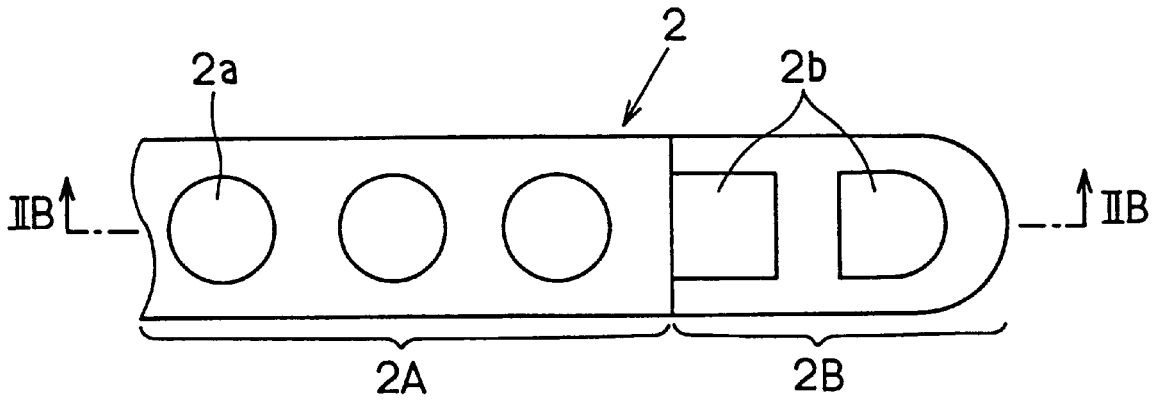
FIG. 2A is a partial top plan view showing a flat tube of the heat exchanger according to the first embodiment.
Figure 2B:
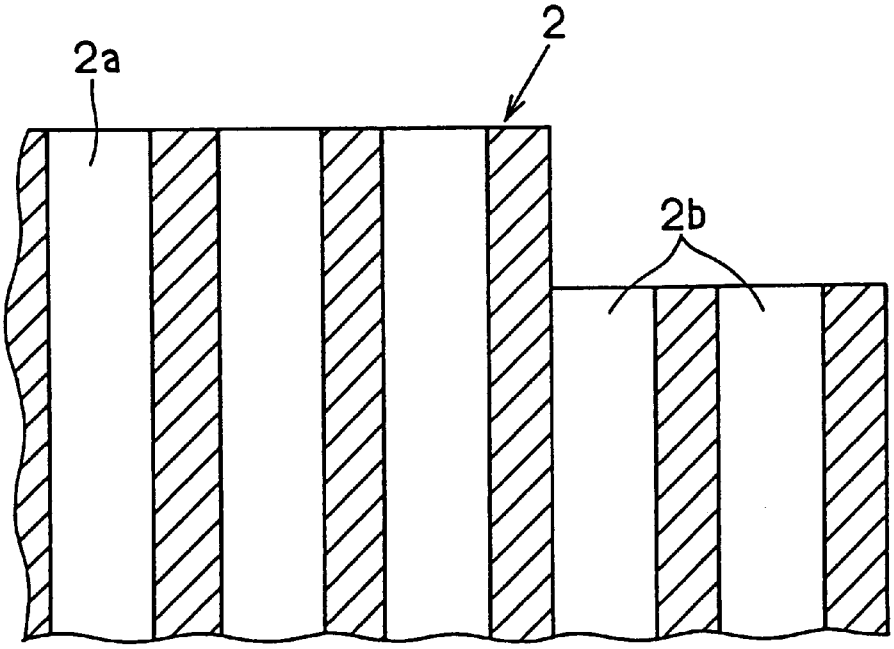
FIG. 2B is a cross-sectional view taken along line IIB—IIB in FIG. 2A.

The flat tube 2 is formed into a flat shape having a relatively small thickness by extrusion. As shown in FIGS. 2A–3, each of the flat tubes 2 has a flow passage portion 2A inserted into the header tanks 4, and a pair of non-flow passage portions 2B disposed at both sides of the flow passage portion 2A to be exposed outside the header tanks 4. Further, as shown in FIG. 2B, each longitudinal end of the non-flow passage portions 2B is formed to be respectively recessed from longitudinal ends of the flow passage portion 2A in a longitudinal direction of the flat tubes 2.

Further, the flow passage portion 2A has plural flow passages 2*a* through which refrigerant flows, and the flow passages 2*a* are equally spaced in a lateral direction of the flat tube 2. The non-flow passage portion 2B has two non-flow passages 2*b* in which no refrigerant flows. In FIGS. 2A, 2B, two non-flow passages 2*b* are indicated; however, the non-flow passage portion 2B may have at least one non-flow passage 2*b*. Each of the flow passages 2*a* has a round-shaped cross-section. On the other hand, one of the non-flow passage 2*b* has a square-shaped cross-section, and the other non-flow passage 2*b* has a substantially semicircular-shaped cross-section. The non-flow passage 2*b* may have any polygonal-shaped cross-section. Therefore, a cross-sectional area of a single flow passage 2*a* is smaller than that of a single non-flow passage 2*b*. That is, a first wall portion for forming each of the flow passages 2*a* is formed thicker than a second wall portion for forming each of the non-flow passage 2*b*.

Referring back to FIG. 1, each of the corrugated fins 3 is formed into a corrugated shape by bending thin metal plate having a large heat conductivity such as aluminum plate. The corrugated fins 3 are attached between each adjacent flat tubes 2, and are bonded to outer surfaces of the flat tubes 2 through brazing or the like.

Each of the header tanks 4 has a cylindrical body 4A formed into an oval-shape in cross-section, and a pair of header caps 4B attached to both longitudinal ends of the cylindrical body 4A to close the longitudinal ends of the cylindrical body 4A. Each of the header tanks 4 is disposed at each of longitudinal ends of the flat tubes 2. As shown in FIG. 3, plural oblong holes 4*a* are formed in a side surface of the header tank 4. Each of the longitudinal end portions of the flat tubes 2 is inserted into the corresponding oblong hole 4*a* so that the flow passages 2*a* of the flat tubes 2 communicate with the header tank 4.

Next, operation of the heat exchanger 1 according to the first embodiment will be described. When the refrigerant cycle starts operating, high-pressure high-temperature gas refrigerant is introduced into one of the header tanks 4 and is distributed into each flat tubes 2. While the gas refrigerant flows through the flow passages 2*a* in the flat tubes 2 toward the other header tank 4, the refrigerant is cooled through heat exchange between the refrigerant and air passing through the heat exchanger 1. As a result, the gas refrigerant is condensed and liquefied. The condensed liquid refrigerant flows into the other header tank 4 through the flow passages 2*a* in the flat tubes 2, and is discharged from the other header tank 4 through an outlet (not shown) connected to the other header tank 4.

According to the first embodiment of the present invention, each of the flow passages 2*a* has a round-shaped cross-section, and each of the non-flow passages 2*b* has a polygonal-shaped cross-section. Therefore, the first wall portion for forming each of the flow passages 2*a* is formed thicker than the second wall portion for forming each of the non-flow passage 2*b*. That is, each of the flow passages 2*a* has a cross-sectional area smaller than that of each of the non-flow passages 2*b*. Therefore, the weight of the non-flow passage portion 2B is decreased, thereby decreasing weight of each flat tube 2. On the other hand, the flow passage portion 2A has a sufficient strength, because each of the flow passages 2*a* has a round-shaped cross-section. Thus, in the first embodiment, weight of the flat tube 2 is decreased, while the flat tube 2 has a sufficient strength.

Next, modifications of the first embodiment will be described with reference to FIGS. 4–7. In the modifications of the first embodiments, components which are similar to those in the first embodiment are indicated with the same reference numerals, and the explanation thereof is omitted.

Figure 4:
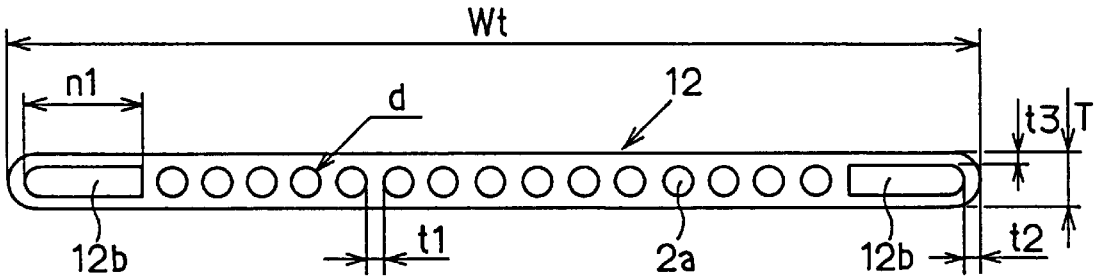
FIG. 4 is a top plan view showing a flat tube according to a modification of the first embodiment.
Figure 5:
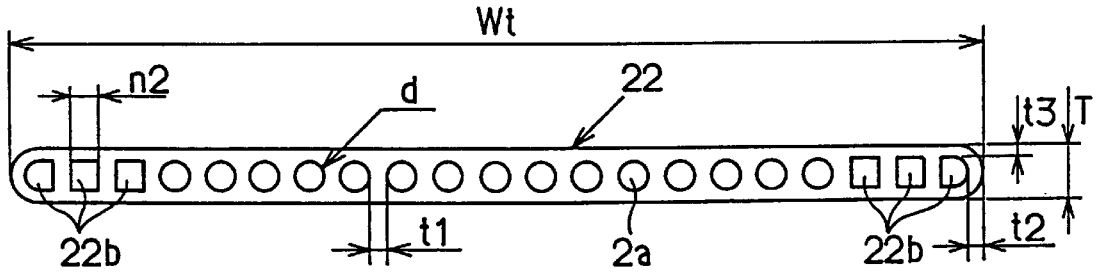
FIG. 5 is a top plan view showing a flat tube according to an another modification of the first embodiment.

As shown in FIG. 4, a tube 12 may have a non-flow passage 12*b* formed into a single passage having an oblong-shaped cross-section extended in the lateral direction of the flat tube 2. As shown in FIG. 5, a tube 22 may have a pair of non-flow passage portions 2B respectively having three non-flow passages 22*b*. Both the flat tubes 12, 22 shown in FIGS. 4, 5 have a cross-sectional area of wall portion, smaller than that of a comparison tube having a non-flow passage portion in which each of non-flow passages has a round-shaped cross-section similarly to the flow passages (hereinafter referred to as comparison tube). That is, each weight of the flat tubes 12, 22 shown in FIGS. 4, 5 is smaller than that of the comparison tube.

For example, each of dimensions of the flat tubes 12, 22 shown in FIGS. 4, 5 and the comparison tube is set as follows, and each cross-sectional area of wall portions of the flat tubes 12, 22 and the comparison tube is calculated and compared therebetween. That is, each lateral width Wt of the flat tubes 12, 22, and the comparison tube is 24 mm, thickness T of the flat tubes in a flattened direction thereof is 1.2 mm, inner diameter d of the flow passage 2*a* is 0.7 mm, a dimension t1 between the adjacent flow passages 2*a* in the lateral direction of the flat tubes is 0.43 mm, a dimension t2 between a most-external non-flow passage and a lateral end of the flat tubes in the lateral direction of the flat tubes is 0.35 mm, a dimension t3 between the passages and a flattened end of the flat tubes in the flattened direction of the flat tubes is 0.25 mm, a lateral dimension n1 of a non-flow passage 12*b* of the flat tube 12 in FIG. 4 is 2.96 mm, a lateral dimension n2 of a non-flow passage 22*b* of the flat tube 22 in FIG. 5 is 0.7 mm, and an inner diameter of a non-flow passage (not shown) of the comparison tube is 0.7 mm. In this case, a cross-sectional wall area of a wall portion of the flat tube 12 shown in FIG. 4 is 18.68 $mm^2$, and a cross-sectional area of a wall portion of the flat tube 22 shown in FIG. 5 is 19.88 $mm^2$, and a cross-sectional area of a wall portion of the comparison tube is 20.41 $mm^2$. Thus, each wall portion of the flat tubes 12, 22 shown in FIGS. 4, 5 has a cross-sectional area smaller than that of the comparison tube. As a result, the flat tubes 12, 22 shown in FIGS. 4, 5 have a decreased weight as compared with the comparison tube.

Figure 3:
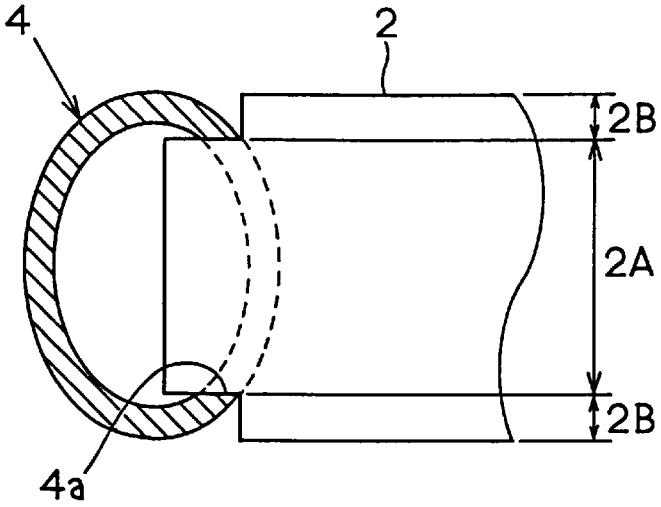
FIG. 3 is a partial sectional view showing a connection structure between the flat tube and a header tank of the heat exchanger according to the first embodiment.
Figure 6:
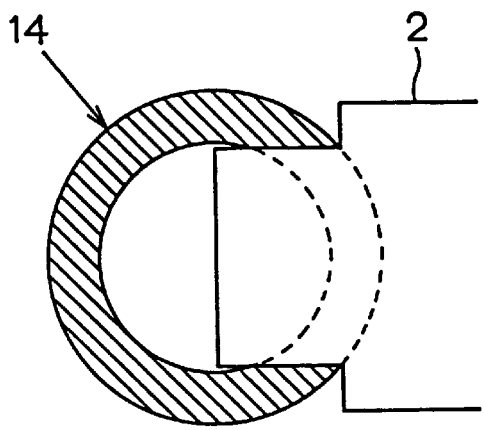
FIG. 6 is a partial sectional view showing a connection structure between the flat tube and a header tank according to an another modification of the first embodiment.
Figure 7:
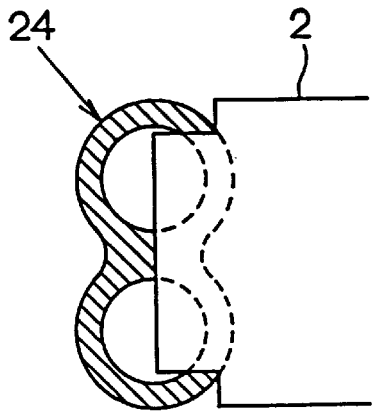
FIG. 7 is a partial sectional view showing a connection structure between the flat tube and a header tank according to an another modification of the first embodiment.

In the above-described first embodiment, each header tank 4 is formed into a oblong shape in cross section, as shown in FIG. 3. However, as shown in FIG. 6, a header tank 14 may have a round-shaped cross-section. Further, as shown in FIG. 7, a header tank 24 may have a 8-shaped cross-section. That is, the header tank 24 may be formed into a shape approximately corresponding to numerical letter eight in cross-section.

The flow passages 2*a* may have an oval-shaped cross-section instead of the round-shaped cross-section. The non-flow passages 2*b* may have a cross-section of any shape besides the shapes shown in FIGS. 2A, 4, 5, provided that the cross-sectional area of the wall portion forming the non-flow passage 2*b* is smaller than that of the wall portion forming the flow passage 2*a*. For example, the non-flow passage 2*b* may have a circular-shaped cross-section having a larger passage area than that of each flow passage 2*a*.

A second preferred embodiment of the present invention will be described with reference to FIGS. 8–12.

Figure 8:
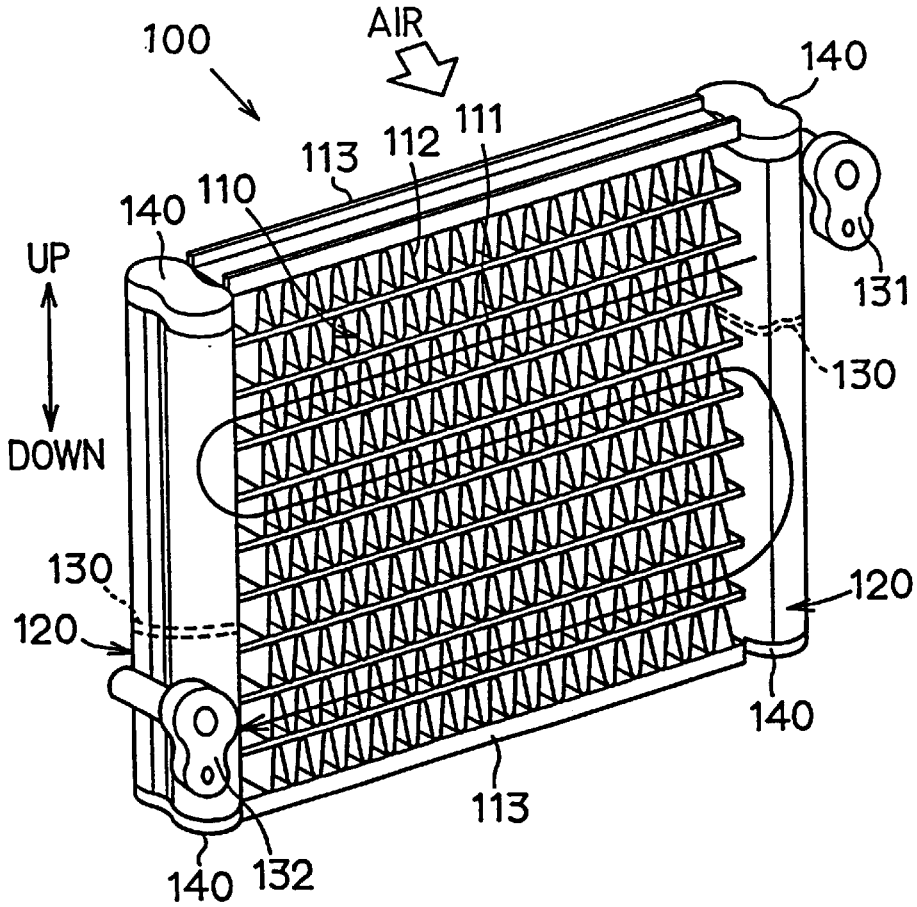
FIG. 8 is a perspective view showing a heat exchanger according to a second preferred embodiment of the present invention.

In the second embodiment, the present invention is typically applied to a radiator 100 of a $CO_2$ refrigerant cycle. As shown in FIG. 8, the radiator 100 has plural laminated flat tubes 111 through which $CO_2$ refrigerant flows, and plural corrugated fins 112 attached between each adjacent tubes 111. The flat tubes 111 are formed through extrusion using aluminum alloy. The corrugated fins 112 are made of aluminum, and are formed into a corrugated shape through a roller forming method. A core portion 110 of the radiator 100 is composed of the flat tubes 111 and the corrugated fins 112. Heat exchange between refrigerant flowing through the flat tubes 111 and air passing through the core portion 110 of the radiator 100 is performed in the radiator 100.

A pair of side plates 113 are attached to the core portion 110 to enhance strength of the core portion 110. The side plates 113 and the flat tubes 111 are bonded to the corrugated fins 112 through brazing, using brazing material coated on both sides of the corrugated fins 112. Further, a pair of header tanks 120 are disposed on both longitudinal ends of the flat tubes 111. The header tanks 120 extend in a direction perpendicular to a longitudinal direction of the flat tubes 111, and communicates with the flat tubes 111. Refrigerant is distributed into the flat tubes 111 from the header tank 120 on the right side in FIG. 8, and is collected into the header tank 120 on the left side in FIG. 8 from the flat tubes 111. The radiator 100 is connected to a compressor (not shown) of the $CO_2$ refrigerant cycle through a connection block 131, and is connected to a decompressor (not shown) of the $CO_2$ refrigerant cycle through a connection block 132.

Figure 9A:
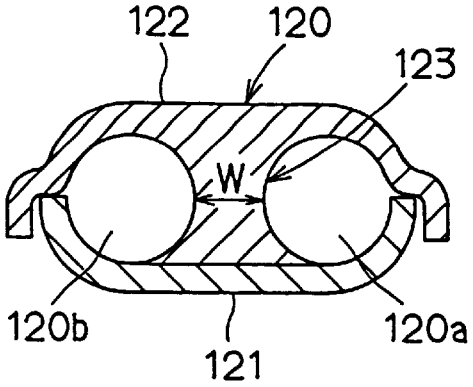
FIG. 9A is a cross-sectional view showing a header tank of the heat exchanger according to the second embodiment.
Figure 9B:
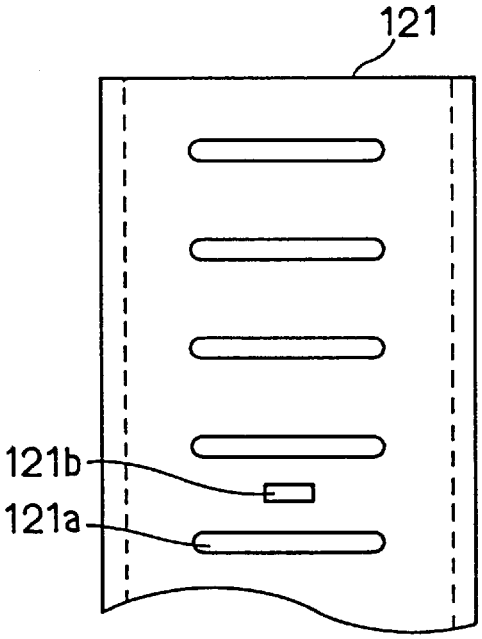
FIG. 9B is a side view showing a first plate of the header tank when viewed from a side of a core portion of the heat exchanger according to the second embodiment.
Figure 9C:
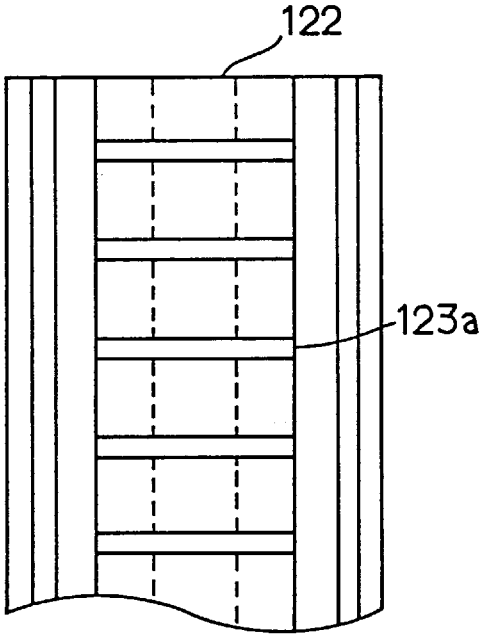
FIG. 9C is a side view showing a second plate of the header tank when viewed from the side of the core portion according to the second embodiment.

As shown in FIGS. 9A–9C, the header tank 120 is composed of a first plate 121 and a second plate 122. The first and second plates 121, 122 are connected to each other to form the header tank 120. The first plate 121 has plural first insertion holes 121*a* formed into an oblong shape. The flat tubes 111 are respectively inserted into the first insertion holes 121*a*. The second plate 122 has an inner partition wall 123 protruding toward the first plate 121 and extending in a longitudinal direction of the header tank 120. The inner partition wall 123 is formed integrally with the second plate 122. A protruding end of the inner partition wall 123 is bonded to an inner wall of the first plate 121, so that the first plate 121 and the second plate 122 are connected with each other by the inner partition wall 123.

That is, the inner partition wall 123 is disposed inside the header tank 120 to extend in the longitudinal direction of the header tank 120. Therefore, an inner space within the header tank 120 is divided into a first space 120*a* and a second space 120*b* extending in the longitudinal direction of the header tank 120 by the inner partition wall 123. Thus, the first and second spaces 120*a*, 120*b* are defined by the first and second plates 121, 122 and the inner partition wall 123.

Further, as shown in FIG. 9C, plural communication passages 123*a* are formed on the protruding end portion of the inner partition wall 123 by milling, so that the first and second spaces 120*a*, 120*b* communicate with each other through the communication passages 123*a*. The communication passages 123*a* are provided at positions corresponding to the first insertion holes 121*a*.

The inner partition wall 123 has a substantially hourglass-shaped cross-section, as shown in FIG. 9A. That is, the inner partition wall 123 is formed to have a width W being increased toward both the inner walls of the first and second plates 121, 122. Therefore, each of the first and second spaces 120*a*, 120*b* has a substantially circular-shaped cross-section. The width W of the inner partition wall 123 is a dimension in a width direction parallel to a longer diameter of the oval-shaped cross-section of the header tank 120. That is, the width direction is perpendicular to both of the longitudinal direction of the flat tubes 111 and the longitudinal direction of the header tank 120.

The first plate 121 is formed by pressing an aluminum material (A3003), and the second plate 122 is formed by extrusion of an aluminum material (A3003). The first plate 121, the second plate 122 including the inner partition wall 123, and the flat tubes 111 are integrally bonded to each other by brazing, using a brazing material (A4004) coated on both sides of the first plate 121.

Figure 10:
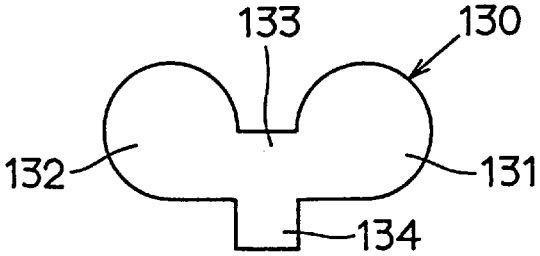
FIG. 10 is a front view showing a separator within the header tank according to the second embodiment.

Further, a separator 130 is disposed within each header tank 120 so that the first and second spaces 120*a*, 120*b* are divided into plural spaces in the longitudinal direction of the header tank 120. Refrigerant flows through the core portion 110 along a S-shaped route indicated by arrow in FIG. 8 due to the separator 130. As shown in FIG. 10, the separator 130 includes first and second plate portions 131, 132 having a substantially circular shape, a connection portion 133 for partially connecting the first and second plate portions 131, 132, and a protruding portion 134 protruding toward the first plate 121. The first and second plate portions 131, 132 air-tightly separate the first and second spaces 120*a*, 120*b*, respectively, into several spaces in the longitudinal direction of the header tank 120. The portions 131–134 of the separator 130 are integrally formed by pressing an aluminum plate (A3003).

As shown in FIG. 9B, the first plate 121 of the header tank 120 has a second insertion hole 121*b* into which the protruding portion 134 of the separator 130 is inserted. The separator 130 is brazed to the inner walls of the first and second plates 121, 122 and the inner partition wall 123, while the protruding portion 134 of the separator 130 is inserted into the second insertion hole 121*b*.

Figure 11:
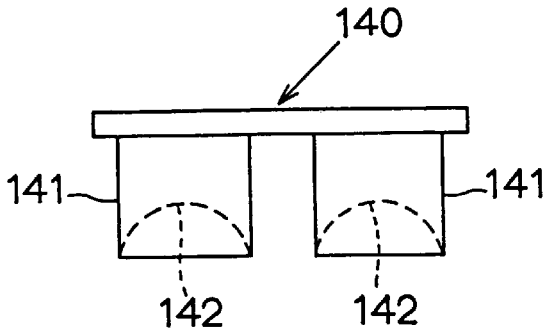
FIG. 11 is a front view showing a header cap of the header tank according to the second embodiment.

Further, as shown in FIG. 8, a pair of header caps 140 (hereinafter referred to as caps 140) made of aluminum are bonded to the longitudinal ends of each header tanks 120 to close the longitudinal ends of the first and second spaces 120*a*, 120*b*. As shown in FIG. 11, the cap 140 has a pair of cylindrical protruding portions 141 which are inserted into the first and second spaces 120*a*, 120*b* of the header tank 120, respectively. Each of the cylindrical protruding portions 141 has a substantially-hemispherical recess portion 142, as shown in FIG. 11. The caps 140 are brazed to the first and second plates 121, 122 of the header tank 120 using brazing material sprayed on the caps 140.

According to the second embodiment of the present invention, each of the first and second spaces 120*a*, 120*b* has a substantially circular-shaped cross-section. Therefore, stress is prevented from being intensively applied to the first and second plates 121, 122 including the connection portion between the inner partition wall 123 and the first plate 121. As a result, pressure tightness (pressure resistance) of the header tank 120 is improved.

Further, the cross-section of the inner partition wall 123 is a hourglass shape in which the width W of the inner partition wall 123 in the width direction is gradually increased toward the inner walls of the first and second plates 121, 122, so that each of the first and second spaces 120*a*, 120*b* have a substantially circular-shaped cross-section. Therefore, a bonding area between the inner partition wall 123 and the first plate 121, and a cross-sectional area of the connection portion between the inner partition wall 123 and the second plate 122 are increased. As a result, bonding strength between the inner partition wall 123 and the first plate 121, and strength of the connection portion between the inner partition wall 123 and the second plate 122 are improved, thereby improving pressure resistance of the header tank 120. Further, the separator 130 is bonded to the first and second plates 121, 122 and the inner partition wall 123, thereby improving pressure tightness of both the header tank 120 and the separator 130.

Further, the separator 130 is brazed to the inner walls of the first and second plates 121, 122 and the inner partition wall 123, while the protruding portion 134 of the separator 130 is inserted into the second insertion hole 121*b* formed on the first plate 121. Therefore, bonding strength between the separator 130 and the header tank 120 is further increased, and the separator 130 is readily attached to the first plate 121.

Furthermore, each the cylindrical protruding portions 141 of the cap 140 has the hemispherical recess portion 142 at a protruding end. Therefore, pressure inside the header tank 120 is applied to the hemispherical recess portion 142 of the cap 140, thereby preventing stress from being intensively applied to the cap 140 and the bonding area between the cap 140 and the header tank 120. As a result, pressure resistance of the header tank 120 can be further improved.

Figure 12:
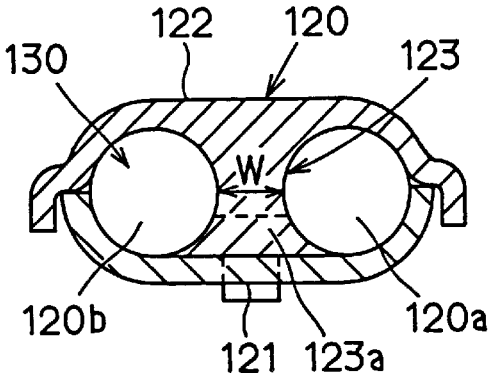
FIG. 12 is a cross-sectional view showing the header tank into which the separator is attached according to the second embodiment.

Further, the connection portion 133 of the separator 130 is formed to partially connect the first and second plate portions 131, 132. Therefore, as shown in FIG. 12, the separator 130 is disposed inside the header tank 120 in such a manner that the separator 130 partially pierces the inner partition wall 123, not fully. Therefore, strength of the inner partition wall 123 is prevented from being greatly decreased due to the separator 130. Thus, the separator 130 can be disposed inside the header tank 120, while it can prevent pressure resistance of the header tank 120 from being reduced.

A third preferred embodiment of the present invention will be described with reference to FIGS. 13A, 13B. In the third embodiment, the header tank 120 is provided so that brazing errors between the inner partition wall 123 and the first plate 121 are readily found.

Figure 13A:
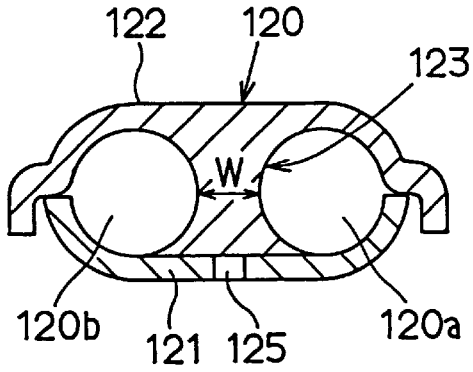
FIG. 13A is a cross-sectional view showing a header tank according to a third preferred embodiment of the present invention.
Figure 13B:
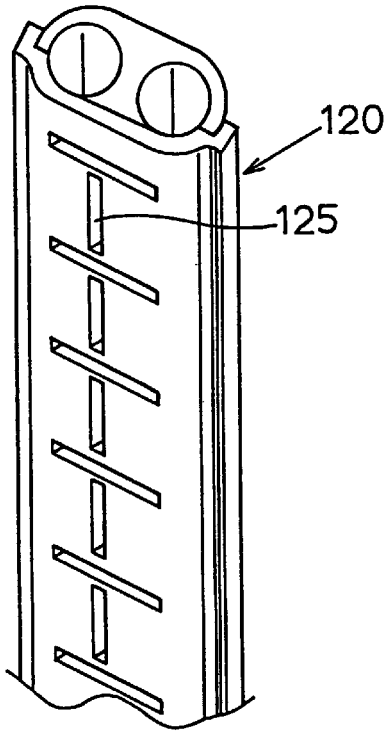
FIG. 13B is a perspective view showing the header tank of the third embodiment.

As shown in FIGS. 13A, 13B, the first plate 121 has a communication hole 125 through which inside and outside of the header tank 120 communicate with each other. The inner partition wall 123 is bonded to the inner wall of the first plate 121 through brazing, so that the communication hole 125 is closed by the inner partition wall 123.

According to the third embodiment of the present invention, when the header tank 120 is filled with an inspection fluid (e.g., inactive gas such as helium) with a predetermined pressure, the inspection fluid leaks from the communication hole 125 if any brazing errors is caused between the inner partition wall 123 and the first plate 121. Thus, any brazing error between the inner partition wall 123 and the first plate 121 is readily found. In the third embodiment, the other portions are similar to those in the second embodiment, and the explanation thereof is omitted.

Figure 14A:
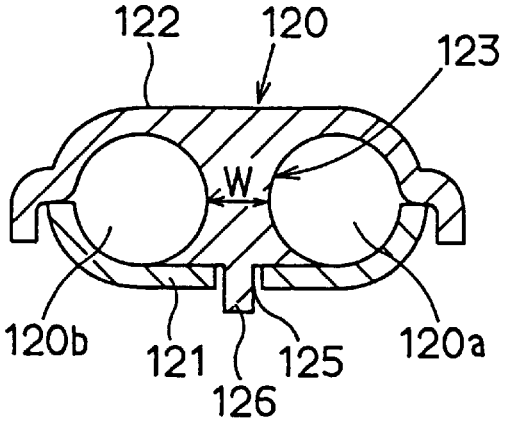
FIG. 14A is a cross-sectional view showing a header tank according to a fourth preferred embodiment of the present invention.
Figure 14B:
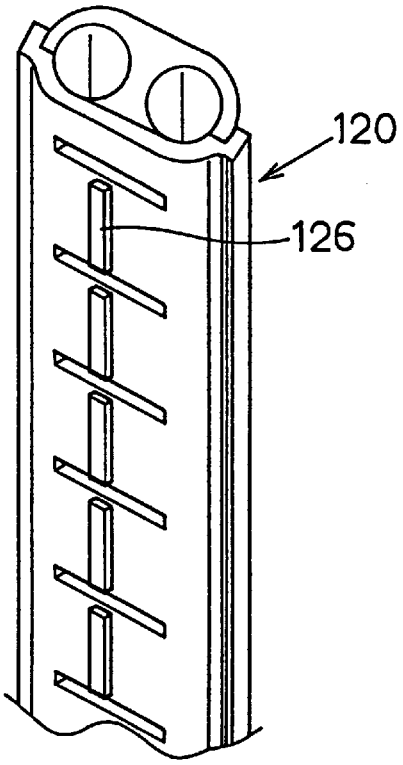
FIG. 14B is a perspective view showing the header tank of the fourth embodiment.

A fourth preferred embodiment of the present invention will be described with reference to FIGS. 14A, 14B. In the fourth embodiment, as shown in FIGS. 14A, 14B, a protruding portion 126 protruding outside of the header tank 120 through the communication hole 125 is formed integrally with the inner partition wall 123. The protruding portion 126 contacts the corrugated fins 112, while the first plate 121 and the corrugated fins 112 are disposed with a predetermined gap (not shown) therebetween.

If the corrugated fins 112 contacts the first plate 121 of the header tank 120, brazing material coated on the first plate 121 is readily drawn toward the corrugated fins 112 due to surface tension of the brazing material on the first plate 121. Therefore, brazing errors between the first plate 121 and the inner partition wall 123, and between the first plate 121 and the flat tubes 111 may be caused.

According to the fourth embodiment of the present invention, because the protruding portion 126 contacts the corrugated fins 112, the protruding portion 126 prevents the corrugated fins 112 from contacting the first plate 121. Therefore, brazing material coated on the first plate 121 is prevented from being drawn toward the fins 112 during brazing. Thus, the first plate 121 and the inner partition wall 123, and the first plate 121 and the flat tubes 111 are securely bonded to each other through brazing, thereby improving pressure resistance of the header tank 120. In the fourth embodiment, the other portions are similar to those in the second embodiment, and the explanation thereof is omitted.

Figure 15A:
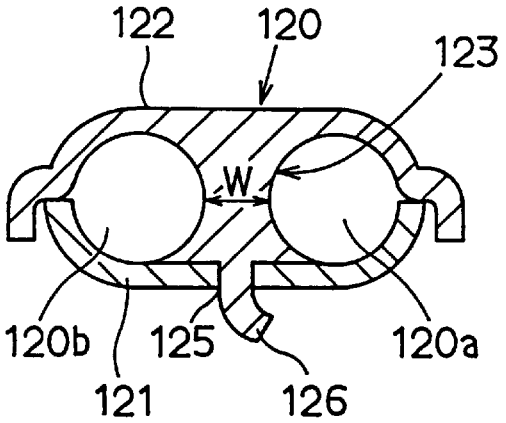
FIG. 15A is a cross-sectional view showing a header tank according to a fifth preferred embodiment of the present invention.
Figure 15B:
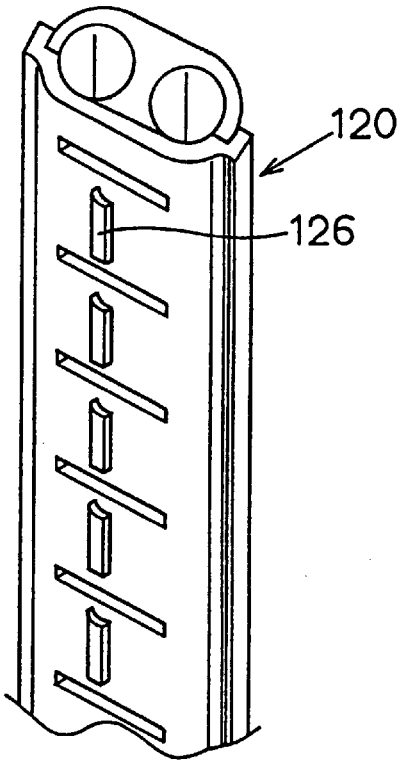
FIG. 15B is a perspective view showing the header tank of the fifth embodiment.

A fifth preferred embodiment of the present invention will be described with reference to FIGS. 15A, 15B. In the fifth embodiment, as shown in FIGS. 15A, 15B, the protruding portion 126 is partially deformed plastically so that the first plate 121 is clamped by the protruding portion 126 of the inner partition wall 123 to be secured to the inner partition wall 123. Therefore, the inner partition wall 123 and the first plate 121 are assuredly bonded to each other through brazing, thereby further improving pressure resistance of the header tank 120. In the fifth embodiment of the present invention, the other portions are similar to those in the second embodiment, and the explanation thereof is omitted.

A sixth preferred embodiment of the present invention will be described with reference to FIGS. 16A, 16B. In the above-described second through fifth embodiment, a milling step for forming the communication passage 123*a* is necessary. However, in the sixth embodiment, the milling step for forming the communication passages 123*a* on the end surface of the inner partition wall 123 is omitted.

Figure 16A:
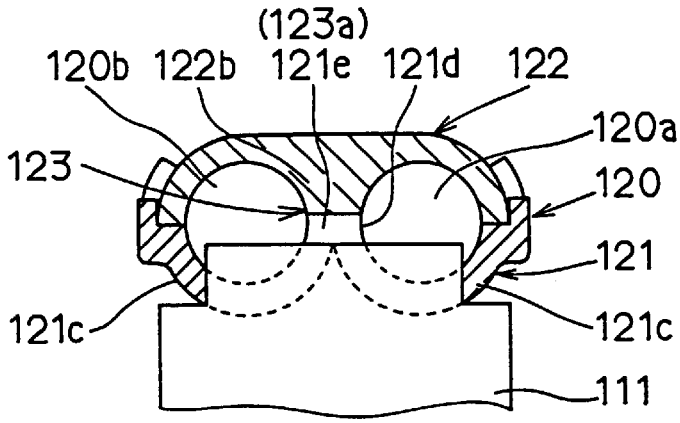
FIG. 16A is a cross-sectional view showing a header tank according to a sixth preferred embodiment of the present invention.
Figure 16B:
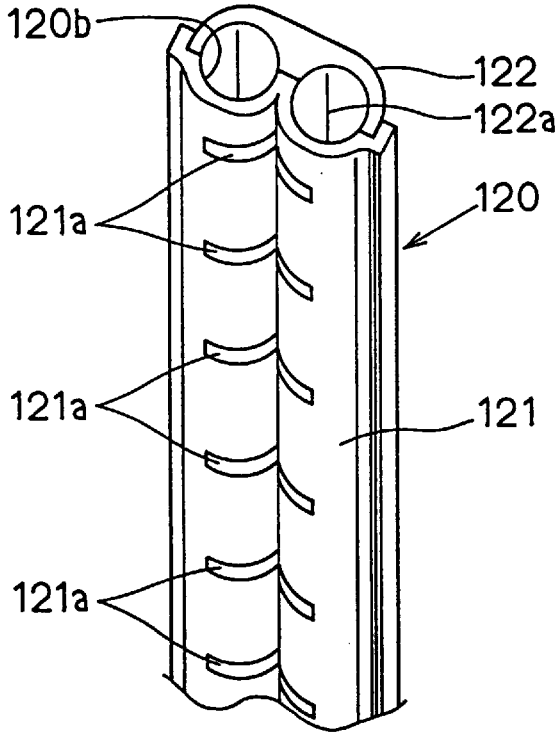
FIG. 16B is a perspective view showing the header tank of the sixth embodiment.

As shown in FIGS. 16A. 16B, the first plate 121 is formed to have a W-shaped cross-section having two semicircular portions 121*c* which protrude toward the flat tube 111. Further, the first plate 121 has a connection portion 121*d* disposed between the two semicircular portions 121*c*, and the second plate 122 has a protruding portion 122*b* which protrudes toward the first plate 121. The connection portion 121*d* of the first plate 121 is bonded to a top end of the protruding portion 122*b* of the second plate 122. Thus, in the sixth embodiment, the protruding portion 122*b* of the second plate 122 and the connection portion 121*d* of the first plate 121 correspond to the inner partition wall 123 in the second through fifth embodiments.

Further, the first insertion holes 121*a* are formed in the first plate 121 by pressing or stamping to penetrate through the first plate 121. When the flat tubes 111 are inserted into the first insertion holes 121*a*, gaps 121*e* are defined between each of the longitudinal ends of the flat tubes 111 and the protruding portion 122*b* of the second plate 122. Therefore, the first and second spaces 120*a,* 120*b* communicate with each other through the gaps 121*e.*

The first plate 121 is formed into a W-shape in cross-section by pressing an aluminum plate during a first pressing step. Then, the first insertion holes 121*a* are formed in the W-shaped first plate 121 by stamping during a second pressing step.

According to the sixth embodiment, the gaps 121*e* (i.e., communication passage 123*a*) through which the first and second spaces 120*a,* 120*b* communicate with each other are simultaneously formed while the first insertion holes 121*a* are formed in the first plate 121, without a milling step. As a result, manufacturing steps of the second plate 122 can be reduced, and the radiator 100 is manufactured in low cost.

Figure 17:
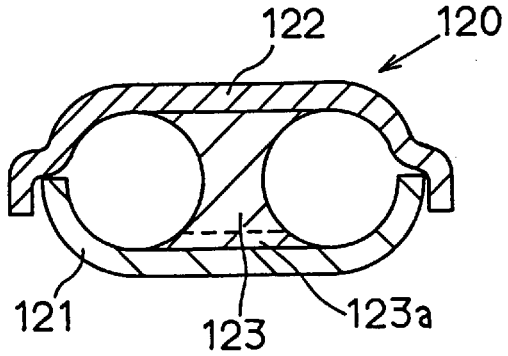
FIG. 17 is a cross-sectional view showing a header tank according to a modification of the second embodiment.
Figure 18:
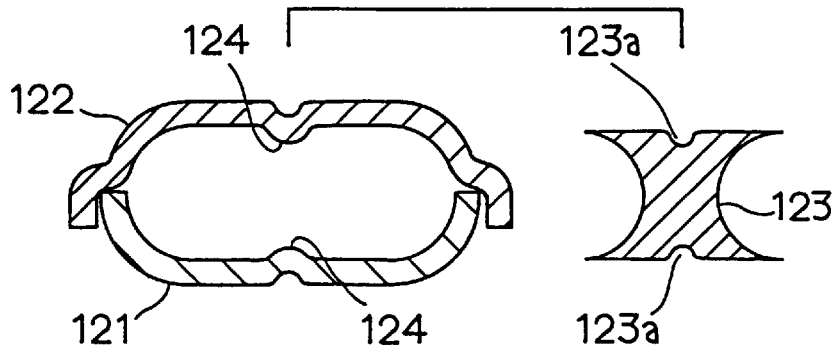
FIG. 18 is an exploded sectional view of a header tank according to an another modification of the second embodiment.

In the above-described second through sixth embodiments, the second plate 122 and the inner partition wall 123 are formed integrally. However, as shown in FIG. 17, the inner partition wall 123 may be separately formed from the second plate 122, and may be brazed to the inner walls of the first and second plates 121, 122 of the header tank 120. In this case, preferably, a protruding portion 124 for determining a connection position is formed on the first and second plates 121, 122, and a recess portion 124*a* into which the protruding portion 124 is inserted is formed on the inner partition wall 123. On the contrary, the protruding portion 124 may be formed on the inner partition wall 123, and the recess portion 124*a* may be formed on the first and second plates 121, 122. In FIG. 18, the protruding portion 124 is formed on the first and second plates 121, 122, and the recess portion 124*a* is formed on the inner partition wall 123.

Figure 19:
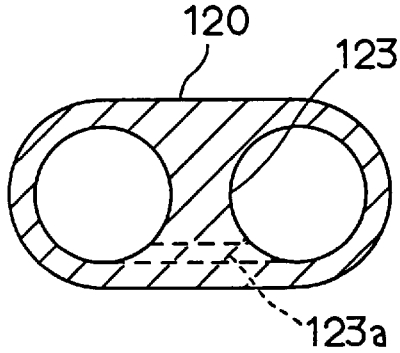
FIG. 19 is a cross-sectional view showing a header tank according to an another modification of the second embodiment.

Further, as shown in FIG. 19, the first and second plates 121, 122 and the inner partition wall 123 may be integrally formed through a method such as extrusion.

Figure 20A:
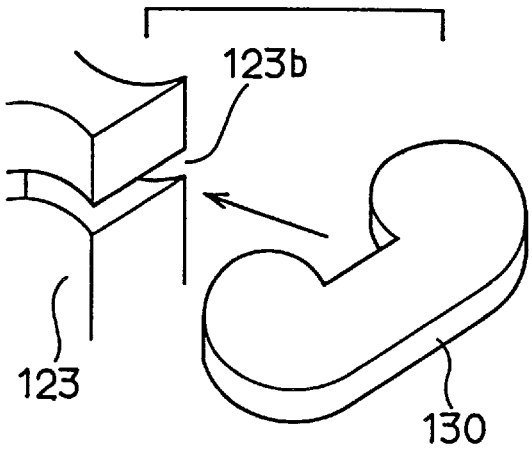
FIG. 20A is a disassemble view showing an assembling structure of a separator and a header tank according to an another modification of the second embodiment.
Figure 20B:
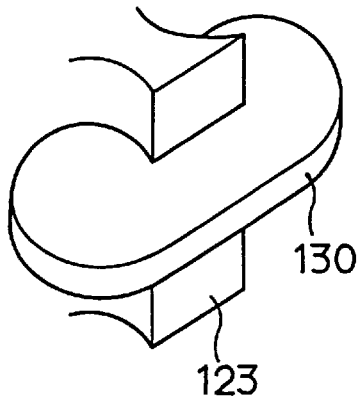
FIG. 20B is a perspective view showing an assembled structure between the separator and the header tank in FIG. 20A.

Further, as shown in FIGS. 20A, 20B, the inner partition wall 123 may have an insertion groove 123*b* formed by milling, into which the connection portion 133 of the separator 130 is inserted. In this case, the second insertion hole 121*b* of the first plate 121 and the protruding portion 134 of the separator 130 can be omitted.

Figure 21A:
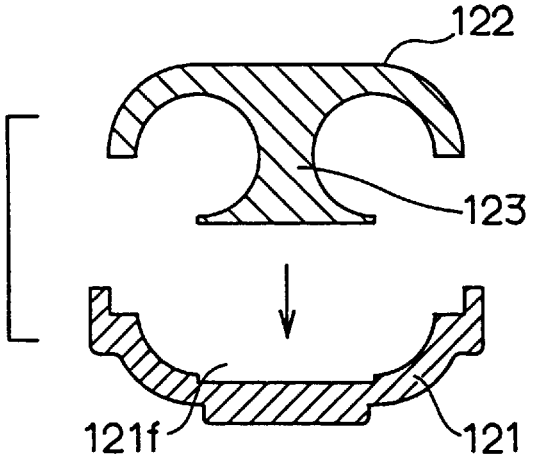
FIG. 21A is a disassemble view of a header tank according to an another modification of the second embodiment.
Figure 21B:
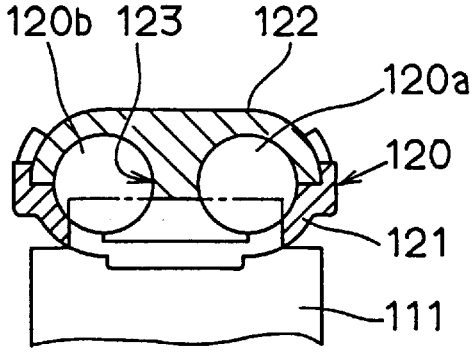
FIG. 21B is a cross-sectional view showing an assembled structure between the header tank in FIG. 21A and a flat tube.

Furthermore, as shown in FIGS. 21A, 21B, a recess portion 121*f* may be formed in the first plate 121 at a position where the inner partition wall 123 is bonded. In this case, the first and second plates 121, 122 are brazed to each other, while the inner partition wall 123 is fitted in the recess portion 121*f.* Therefore, the second plate 122 is readily positioned on the first plate 121, and a contacting area between the first and second plates 121, 122 is increased. As a result, the first and second plates 121, 122 are more securely brazed to each other. Further, each of the cross-section of the first and second spaces 120*a,* 120*b* is formed into an almost genuine circular shape, thereby preventing stress from being intensively applied to the first and second plates 121, 122.

Figure 22:
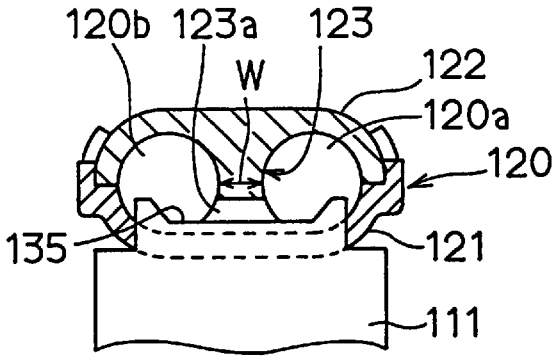
FIG. 22 is a cross-sectional view showing a header tank and a flat tube according to an another modification of the second embodiment.

Further, as shown in FIG. 22, the communication passage 123*a* may be formed on a side adjacent to the flat tube 111 with respect to a portion of the inner partition wall 123 with a minimum width W, while a recess portion 135 is formed at one longitudinal end of the flat tube 111 to be recessed toward the other longitudinal end of the flat tube 111. The recess portion 135 is also formed at the other longitudinal end of the flat tube 111. As a result, a cut-out portion of the inner partition wall 123 is decreased relatively, thereby improving pressure resistance of the header tank 120. Further, since the flat tube 111 has the recess portions 135 at both longitudinal ends, a fluid-flowing area of the communication passage 123*a* is prevented from being reduced even when the cut-out portion of the inner partition wall 123 is decreased. Further, when flux including silicon powder is applied to only a portion of the second plate 122 to which the first plate 121 is bonded, and one longitudinal end of the flat tube 111 is shifted by a predetermined distance toward the other longitudinal end of the flat tube 111, the flow passages of the flat tube 111 are prevented from being blocked by brazing material. In this case, the forming step of the recess portion 135 at the longitudinal end of the flat tube 111 is omitted.

Figure 23:
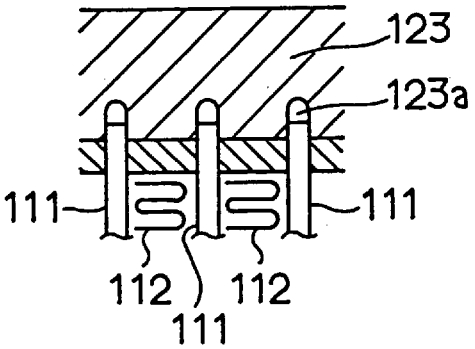
FIG. 23 is a partial sectional view showing a connection structure between a header tank and flat tubes according to an another modification of the second embodiment.

Further, as shown in FIG. 23, the communication passages 123*a* may be formed by cutting the inner partition wall 123 so that each of the communication passages 123*a* has a U-shaped cross-section.

Figure 24:
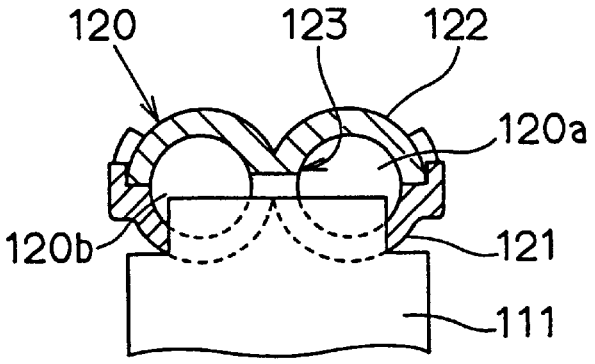
FIG. 24 is a cross-sectional view showing a header tank and a flat tube according to an another modification of the second embodiment.

Furthermore, as shown in FIG. 24, each of the first and second plates 121, 122 may be formed by pressing a plate. In this case, when at least one of the first and second plates 121, 122 is coated with brazing material, brazing error between the first and second plates 121, 122 is decreased. Further, the second plate 122 formed by a pressing step has a higher mechanical strength as compared with a case where the second plate 122 is formed by extrusion or drawing, thereby improving pressure resistance of the header tank 120.

The second through sixth embodiments may be applied to a radiator without the separator 130, in which refrigerant flows through the core portion in one-way. Further, the second through sixth embodiments are not limited to a radiator of the $CO_2$ refrigerant cycle, but may be applied to any heat exchanger with a high operating internal pressure.

A seventh preferred embodiment of the present invention will be described with reference to FIGS. 25–28. In the seventh embodiment, the present invention is applied to a radiator of the $CO_2$ refrigerant cycle, similarly to the second embodiment.

Figure 25:
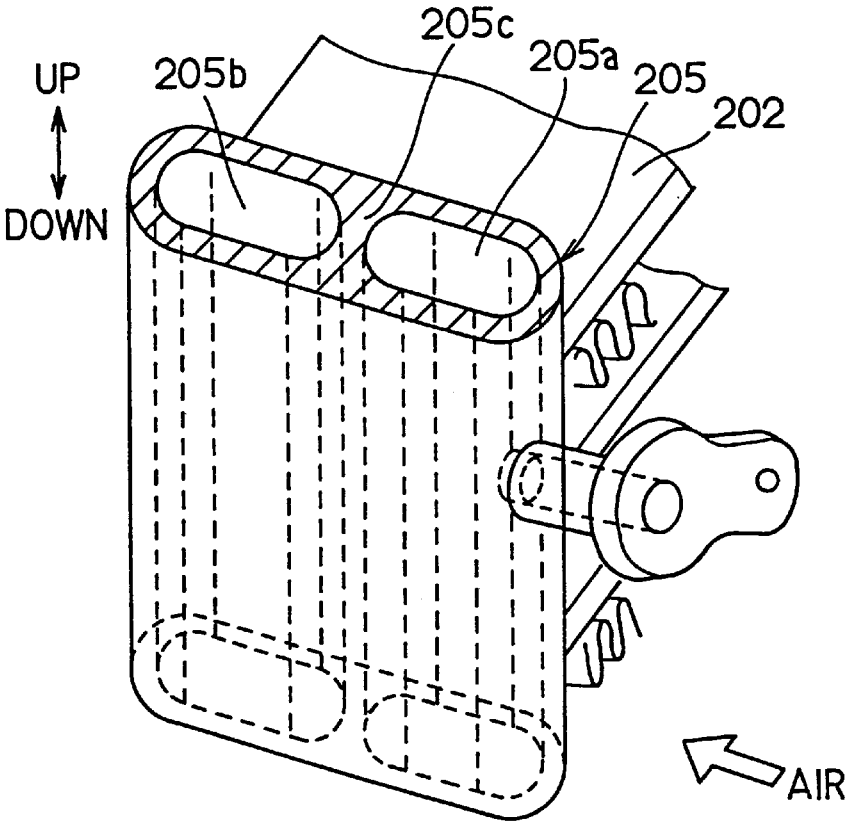
FIG. 25 is a perspective view showing a header tank of a radiator produced on a trial basis by the inventor of the present invention.

As shown in FIG. 25, the inventors of the present invention experimentally produced and studied a radiator having a header tank 205 in which a partition wall 205*c* is provided so that the header tank 205 has a sufficient pressure resistance without increasing size of the header tank 205. The partition wall 205*c* extends in a longitudinal direction of the header tank 205, and divides the header tank 205 into first and second tank spaces 205*a,* 205*b* communicating with flat tubes 202.

However, the inventors of the present invention found that the radiator having the header tank 205 including the first and second spaces 205*a,* 205*b* has insufficient radiation performance. Further, since the header tank 205 is divided into the first and second spaces 205*a,* 205*b,* refrigerant may not be introduced into all of the first and second spaces 205*a,* 205*b.*

Figure 26:
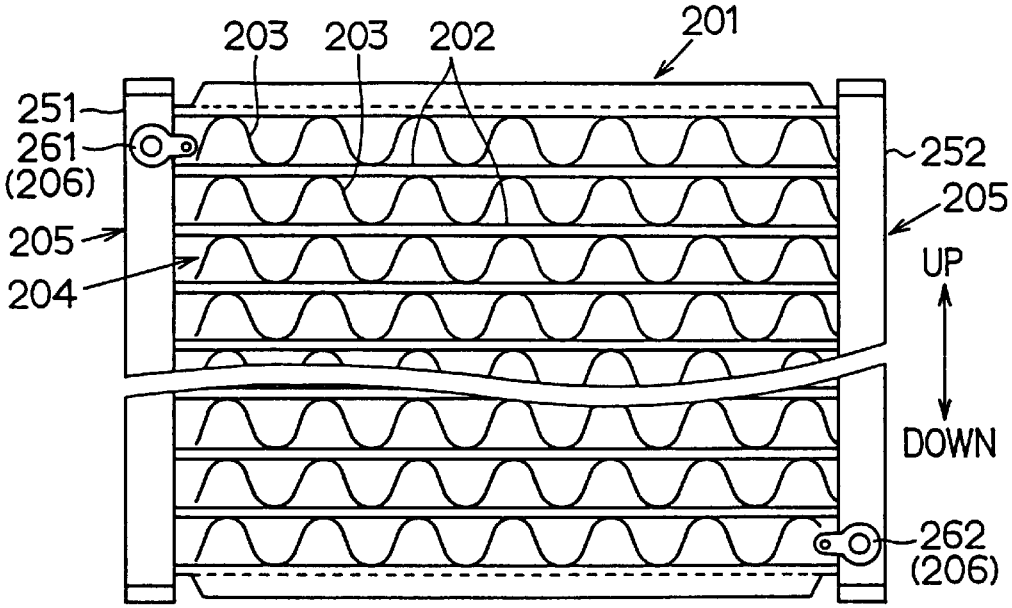
FIG. 26 is a front view showing a radiator according to a seventh preferred embodiment of the present invention.
Figure 28:
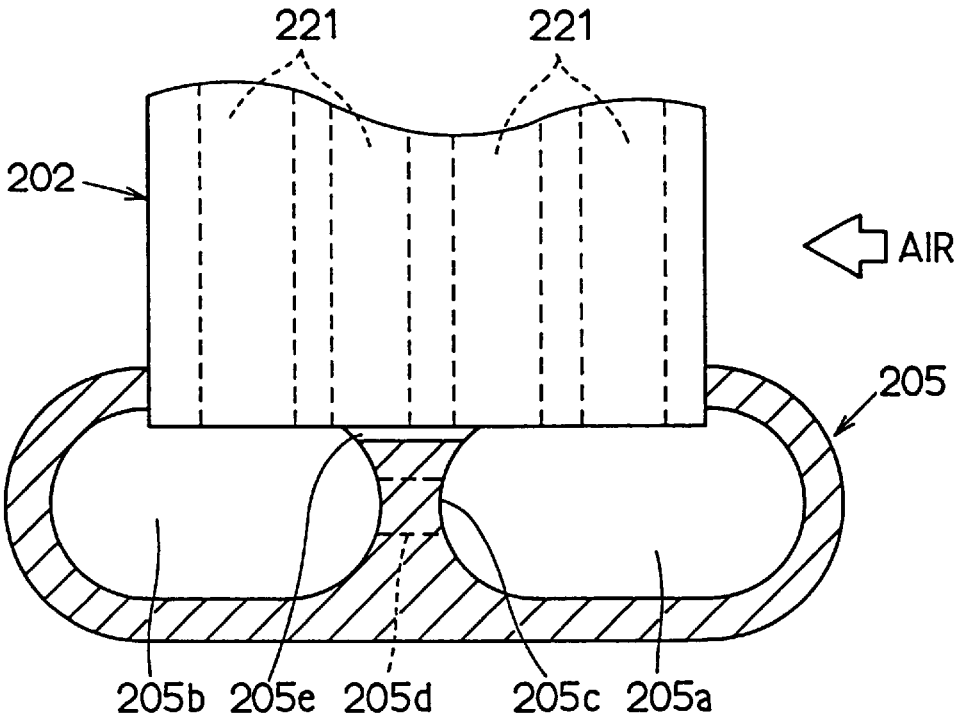
FIG. 28 is a cross-sectional view of the header tank and a tube according to the seventh embodiment.

The seventh embodiment is invented to overcome the above-mentioned problems. FIG. 26 shows a radiator 201 when viewed from an upstream air side thereof. The radiator 201 has plural flat tubes 202 made of aluminum alloy, through which $CO_2$ refrigerant flows. As shown in FIG. 28, each of the flat tubes 202 has plural flow passages 221 extending in a longitudinal direction of the flat tubes 202. Further, plural aluminum corrugated fins 203 are attached between each adjacent flat tubes 202 to facilitate heat exchange between refrigerant and air. A heat-exchange core portion 204 is composed of the flat tubes 202 and the corrugated fins 203.

Each of the flat tubes 202 is integrally formed by extrusion or drawing. The corrugated fins 203 are formed by a roller forming method or the like. The flat tubes 202 and the corrugated fins 203 are brazed to each other using brazing material coated on both sides of the corrugated fins 203.

Further, a header tank 251 for distributing refrigerant into each of the flat tubes 202 is disposed on one longitudinal end side of the flat tubes 202 (i.e., on the left side in FIG. 26), and a header tank 252 into which refrigerant flowing from the flat tubes 202 is collected is disposed on the other longitudinal end side of the flat tubes 202 (i.e., on the right side in FIG. 26). The header tanks 251, 252 extend in a direction perpendicular to the longitudinal direction of the flat tubes 202.

Further, a connection block 261 is attached to an upper part of the header tank 251, and a connection block 262 is attached to a lower part of the header tank 252. The header tank 251 communicate with an outlet pipe (not shown) of a compressor (not shown) of the $CO_2$ refrigerant cycle through the connection block 261. The header tank 252 communicates with an outlet pipe (not shown) of a decompressor (not shown) of the $CO_2$ refrigerant cycle through the connection block 262. Hereinafter, both of the header tanks 251, 252 are generically referred to as the header tank 205, and both of the connection blocks 261, 262 are generically referred to as the connection block 206.

Figure 27:
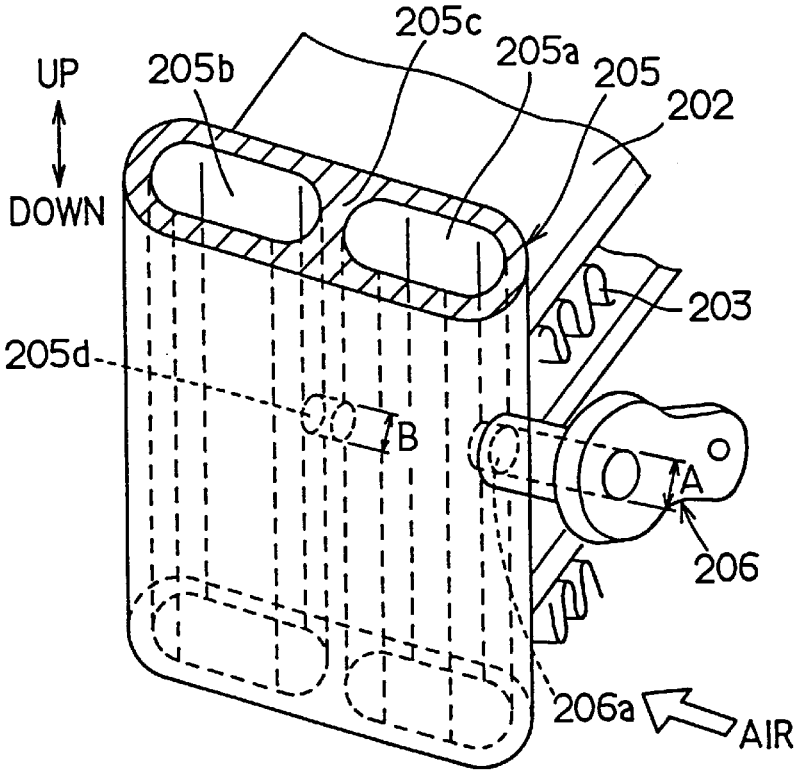
FIG. 27 is a perspective view showing a header tank of the radiator according to the seventh embodiment.

As shown in FIG. 27, the header tank 205 has an inner partition wall 205*c* for partitioning an inside space of the header tank 205 into first and second spaces 205*a*, 205*b*. The inner partition wall 205*c* is integrally formed with the header tank 205 and extends in the longitudinal direction of the header tank 205. The inner partition wall 205*c* has an inner communication hole 205*d* through which the first and second spaces 205*a*, 205*b* communicates with each other. The inner communication hole 205*d* is provided at a position corresponding to the connection block 206. That is, the inner communication hole 205*d* is in alignment with the connection block 206. The first space 205*a* is disposed at an upstream air side of the second space 205*b* in the header tank 205.

Further, an outer communication hole 206*a* through which the first space 205*a* and the connection block 206 communicate with each other is formed in the header tank 205. In the seventh embodiment, an opening area S1 of the inner communication hole 205*d* is set to be smaller than an opening area S2 of the outer communication hole 206*a*, so that an amount of refrigerant flowing in the first space 205*a* becomes larger than an amount of refrigerant flowing in the second space 205*b*. As shown in FIG. 27, when diameter of the inner communication hole 205*d* is set to "B", and diameter of the outer communication hole 206*a* is set to "A", S1, S2 are defined as $\pi B^2/4$, $\pi A^2/4$, respectively. Further, as shown in FIG. 28, the inner partition wall 205*c* is formed in such a manner that a communication passage 205*e* is formed between the flat tubes 202 and the inner partition wall 205*c*. As a result, refrigerant in the header tank 205 can be introduced into a flow passage 221 which is positioned to be opposite to the inner partition wall 205*c*.

According to the seventh embodiment of the present invention, the amount of refrigerant flowing through the first space 205*a* disposed on the upstream air side of the second space 205*b* is larger than the amount of refrigerant flowing through the second space 205*b*. Therefore, more refrigerant flows through the flow passages 221 disposed on the upstream air side, where temperature of air is relatively low. As a result, refrigerant is cooled more efficiently, thereby improving radiation performance of the radiator 201. Thus, in the seventh embodiment, both of pressure resistance and radiation performance of the radiator 201 are improved without increasing size of the radiator 201.

Figure 29:
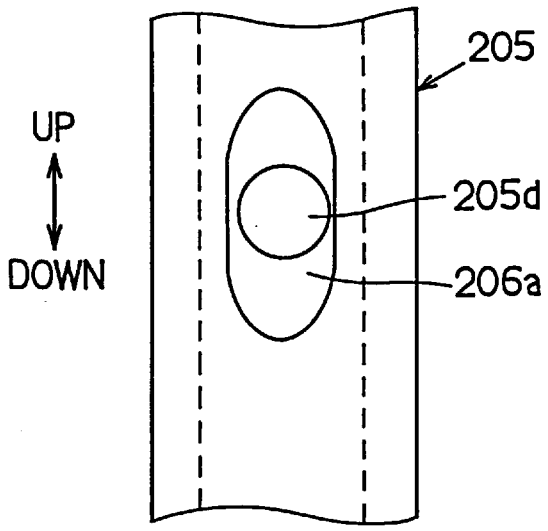
FIG. 29 is a schematic side view showing a part of the header tank according to the seventh embodiment.

An eighth preferred embodiment of the present invention will be described with reference to FIGS. 29–30.

In the above-described seventh embodiment, as shown in FIG. 28, the header tank 205 has a substantially oblong-shaped cross-section similarly to that of the flat tube 202, because the first and second spaces 205*a*, 205*b* are formed within the header tank 205. Therefore, as shown in FIG. 29, when the opening area S2 of the outer communication hole 206*a* is increased, the outer communication hole 206*a* becomes in an oblong or oval shape extending in the longitudinal direction of the header tank 205. However, when the outer communication hole 206*a* is formed into an oblong or oval shape, pressure resistance of the header tank 205 is lowered.

Figure 30:
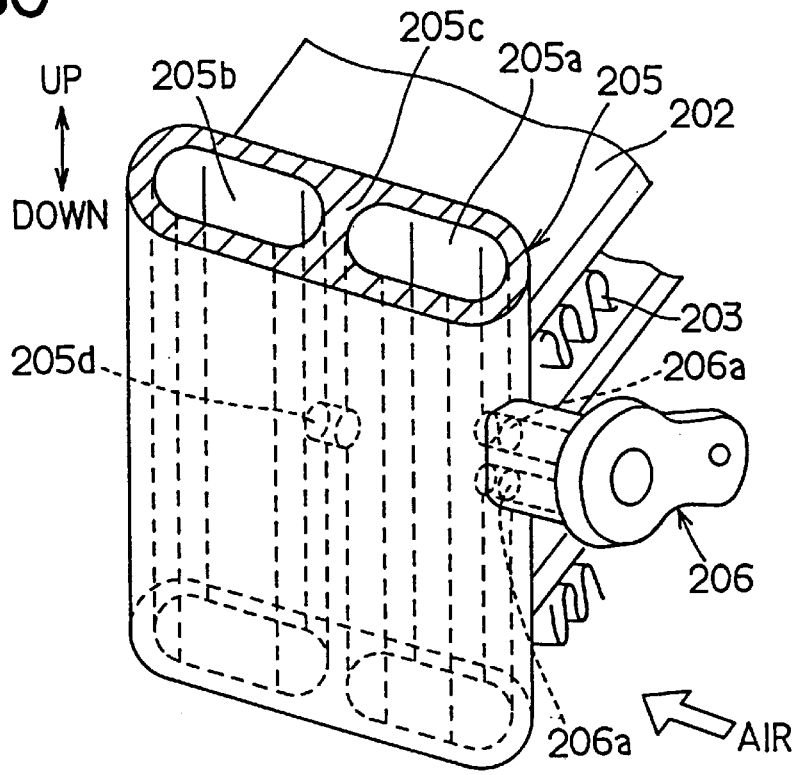
FIG. 30 is a perspective view showing a header tank of a radiator according to an eighth preferred embodiment of the present invention.

In the eighth embodiment of the present invention, as shown in FIG. 30, plural outer communication holes 206*a* communicating with the single external pipe through the single connection block 206 is formed in the header tank 205. Further, the opening area S1 of the inner communication hole 205*d* is set to be smaller than the total opening area S2 of the outer communication holes 206*a*.

According to the eighth embodiment of the present invention, each opening area or opening diameter of the plural outer communication holes 206*a* is decreased. Therefore, pressure resistance of the header tank 205 is prevented from being greatly decreased, while the opening area S1 of the inner communication hole 205*d* is set to be smaller than the total opening area S2 of the outer communication holes 206*a*. In the eighth embodiment, the other portions are similar to those in the seventh embodiment, and the explanation thereof is omitted.

A ninth preferred embodiment of the present invention will be described with reference to FIG. 31.

Figure 31:
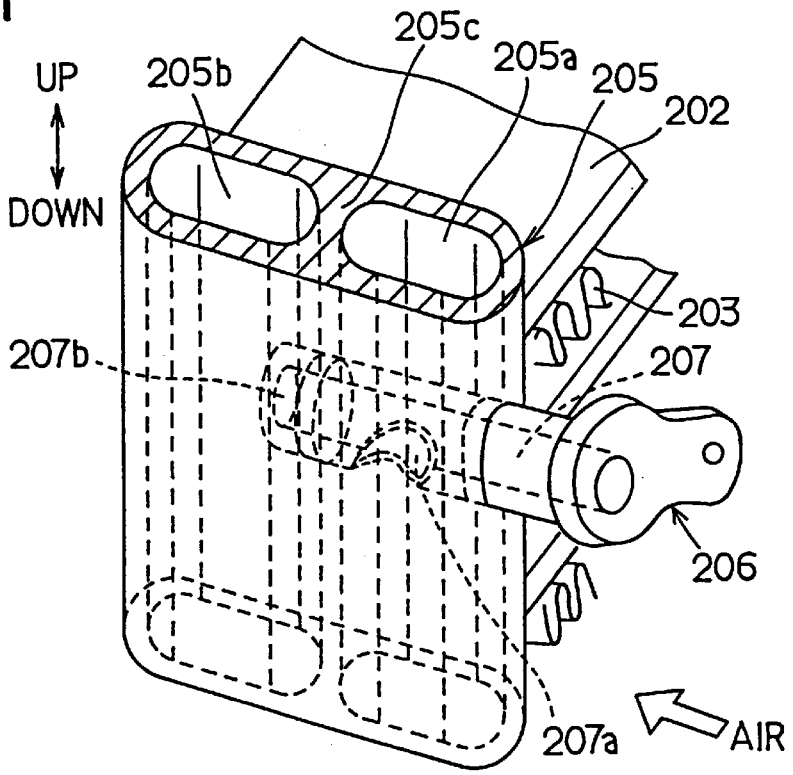
FIG. 31 is a perspective view showing a header tank of a radiator according to a ninth preferred embodiment of the present invention.

As shown in FIG. 31, an aluminum pipe 207 is integrally brazed to the connection block 206. The aluminum pipe 207 is disposed in the header tank 205 to penetrate through the first space 205*a* and the inner partition wall 205*c* and to reach to the second space 205*b*. The connection block 206 is integrally connected to the header tank 205 through the pipe 207. Further, the pipe 207 has a first opening 207*a* opened into the first space 205*a*, and a second opening 207*b* opened into the second space 205*b*. An opening area of the first opening 207*a* is set to be larger than that of the second opening 207*b* so that the amount of refrigerant flowing into the first space 205*a* becomes larger than the amount of refrigerant flowing into the second space 205*b*.

According to the ninth embodiment of the present invention, the pipe 207 enhances strength of the header tank 205, thereby improving pressure resistance of the header tank 205. In the ninth embodiment, the other portions are similar to those in the seventh embodiment, and the explanation thereof is omitted.

A tenth preferred embodiment of the present invention will be described with reference to FIGS. 32A, 32B.

Figure 32A:
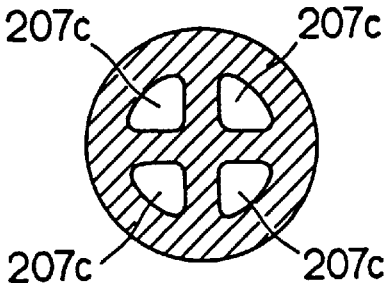
FIGS. 32A, 32B are cross-sectional views showing a pipe of a radiator according to a tenth preferred embodiment of the present invention.
Figure 32B:
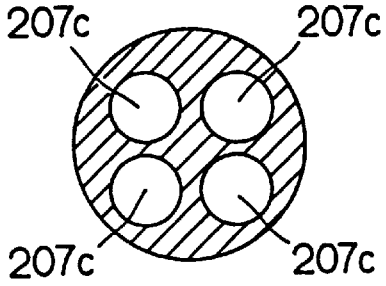

As shown in FIGS. 32A, 32B, in the tenth embodiment, the pipe 207 has plural flow passages 207*c* extending in a longitudinal direction of the pipe 207, thereby improving pressure resistance of the pipe 207. In the tenth embodiment, the other portions are similar to those in the ninth embodiment, and the explanation thereof is omitted.

An eleventh preferred embodiment of the present invention will be described with reference to FIGS. 33–34C.

Figure 33:
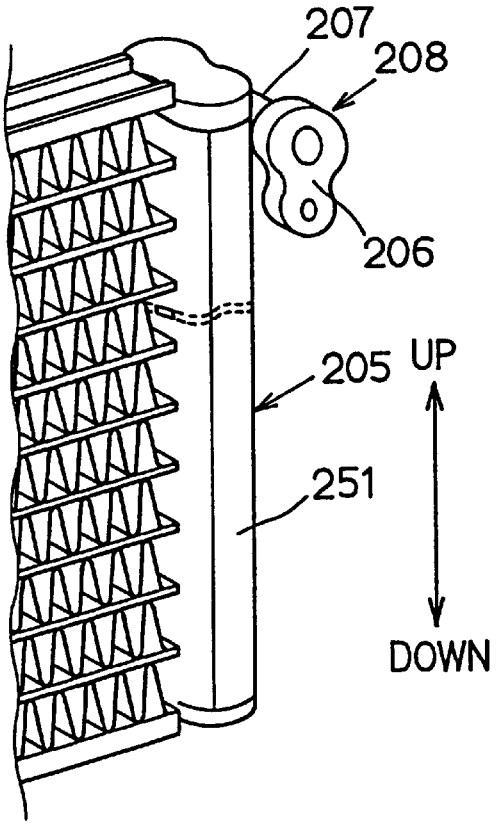
FIG. 33 is a perspective view showing a part of a radiator according to an eleventh preferred embodiment of the present invention.

As shown in FIG. 33, in the eleventh embodiment, a supplying member 208 for supplying refrigerant into first and second spaces 205*a,* 205*b* of the header tank 205 is disposed on a side surface of the header tank 205. That is, the supplying member 208 is disposed on an outer surface of the header tank 205 in the longitudinal direction of the flat tubes 202. The supplying member 208 includes the connection block 206 and the pipe 207.

Figure 34A:
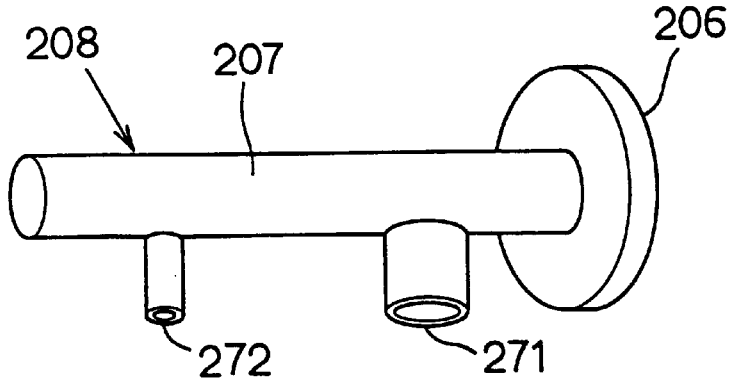
FIG. 34A is a perspective view showing a supplying member for a header tank according to the eleventh embodiment.
Figure 34B:
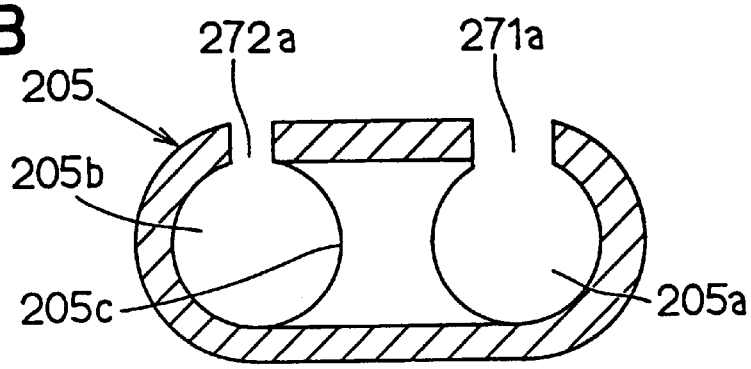
FIG. 34B is a cross-sectional view showing the header tank of the eleventh embodiment.
Figure 34C:
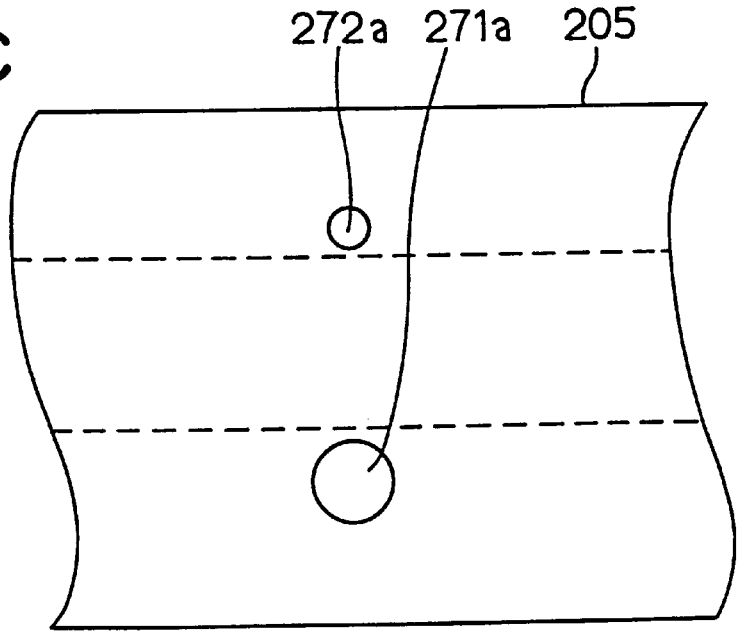
FIG. 34C is a schematic side view showing the header tank according to the eleventh embodiment.

As shown in FIG. 34A, the pipe 207 has a first communication portion 271 communicating with the first space 205*a* and a second communication portion 272 communicating with the second space 205*b*. A cross-sectional area of the first communication portion 271 is set to be larger than that of the second communication portion 272, so that the amount of refrigerant flowing through the first space 205*a* is larger than the amount of refrigerant flowing through the second space 205*b*. Further, as shown in FIGS. 34B, 34C, the header tank 205 has a first hole 271*a* into which the first communication portion 271 is inserted, and a second hole 272*a* into which the second communication portion 272 is inserted. The connection block 206, the pipe 207 and the header tank 205 are integrally connected through brazing. In the eleventh embodiment, the same effect in the seventh through tenth embodiments can be obtained.

Figure 35:
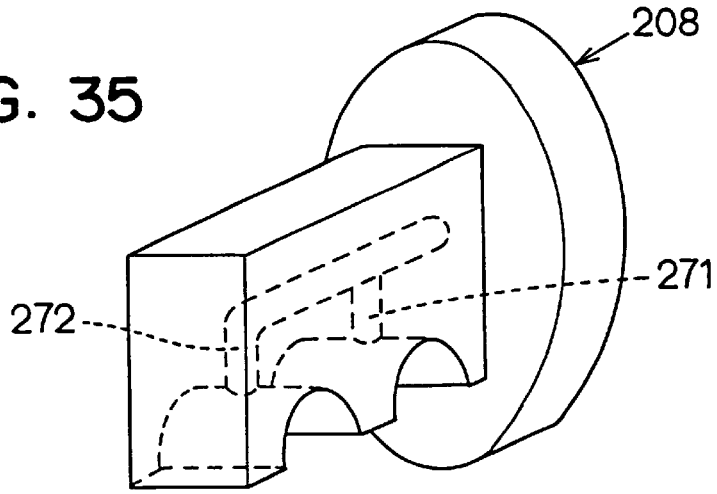
FIG. 35 is a perspective view showing a supplying member of a radiator according to a twelfth preferred embodiment of the present invention.

A twelfth preferred embodiment of the present invention will be described with reference to FIG. 35. In the above-described eleventh embodiment, the connection block 206 and the pipe 207 are connected through brazing to form the supplying member 208. However, in the twelfth embodiment, the connection block 206 and the pipe 207 having the first and second communication portions 271, 272 are integrally formed through cutting and casting such as die-casting.

Figure 36A:
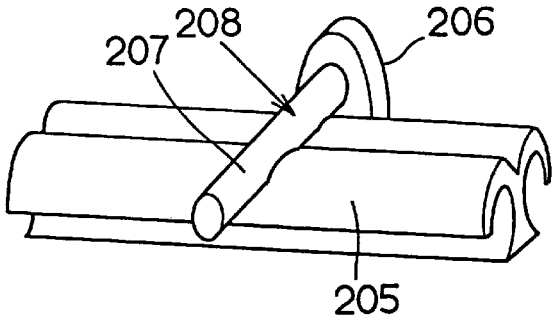
FIG. 36A is a perspective view showing a supplying member and a part of a header tank of a radiator according to a thirteenth preferred embodiment of the present invention.
Figure 36B:
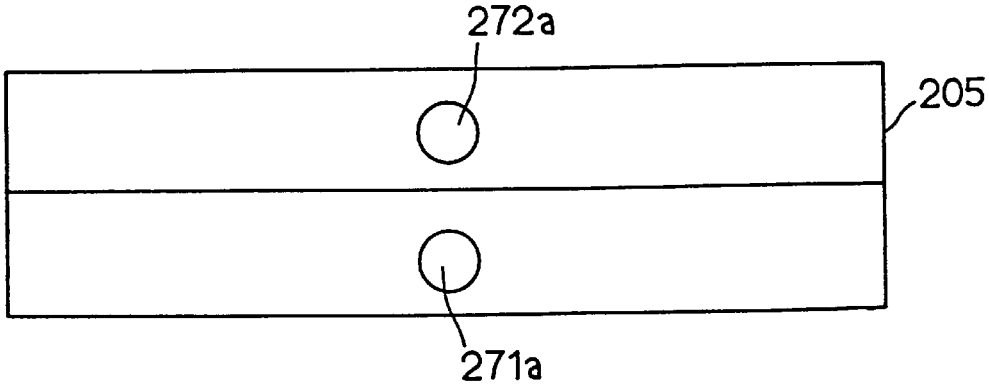
FIG. 36B is a schematic side view showing the header tank of the thirteenth embodiment.

A thirteenth preferred embodiment of the present invention will be described with reference to FIGS. 36A. 36B. In the thirteenth embodiment, the cross-sectional area of the first hole 271*a* is set to be equal to that of the second hole 272*a*. In this case, refrigerant is introduced into both the first and second spaces 205*a,* 205*b* of the header tank 205 without fail, even though the header tank 205 is divided into the first and second spaces 205*a,* 205*b*.

In the above-mentioned seventh through thirteenth embodiments, the header tanks 251, 252 on both sides of the core portion have the same structure. However, only the header tank 251 may have the above-mentioned structure.

Further, in the above-described ninth and tenth embodiments, the pipe 207 is inserted from the first space 205*a*. However, the pipe 207 may be inserted from the second space 205*b*.

The seventh through thirteenth embodiments are not limited to a radiator of the $CO_2$ refrigerant cycle, but may be also applied to any heat exchanger having a high internal pressure.

In the seventh through thirteenth embodiments, refrigerant flows through the tubes of the heat exchanger in one way; however, refrigerant may flow through the tubes of the heat exchanger along a U-shaped or a S-shaped route.

Figure 37:
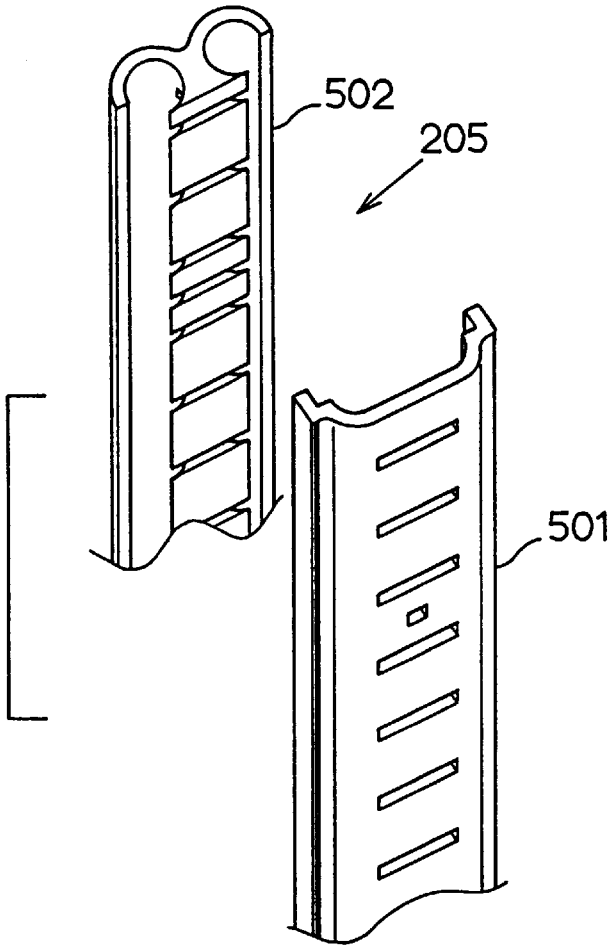
FIG. 37 is an exploded perspective view of a header tank according to a modification of the seventh embodiment.
Figure 38:
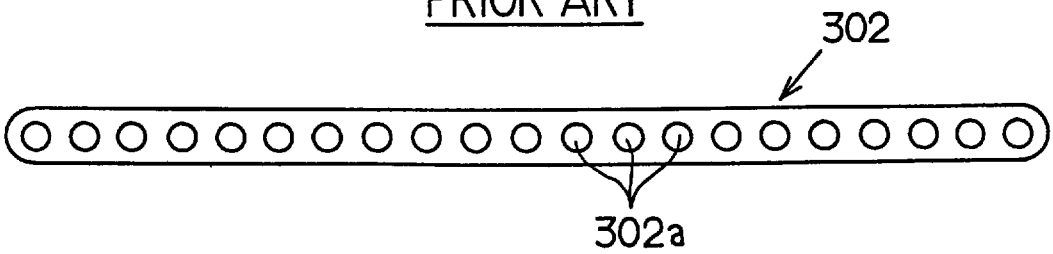
FIG. 38 PRIOR ART
FIG. 38 is a top plan view showing a flat tube of a conventional heat exchanger.
Figure 39:
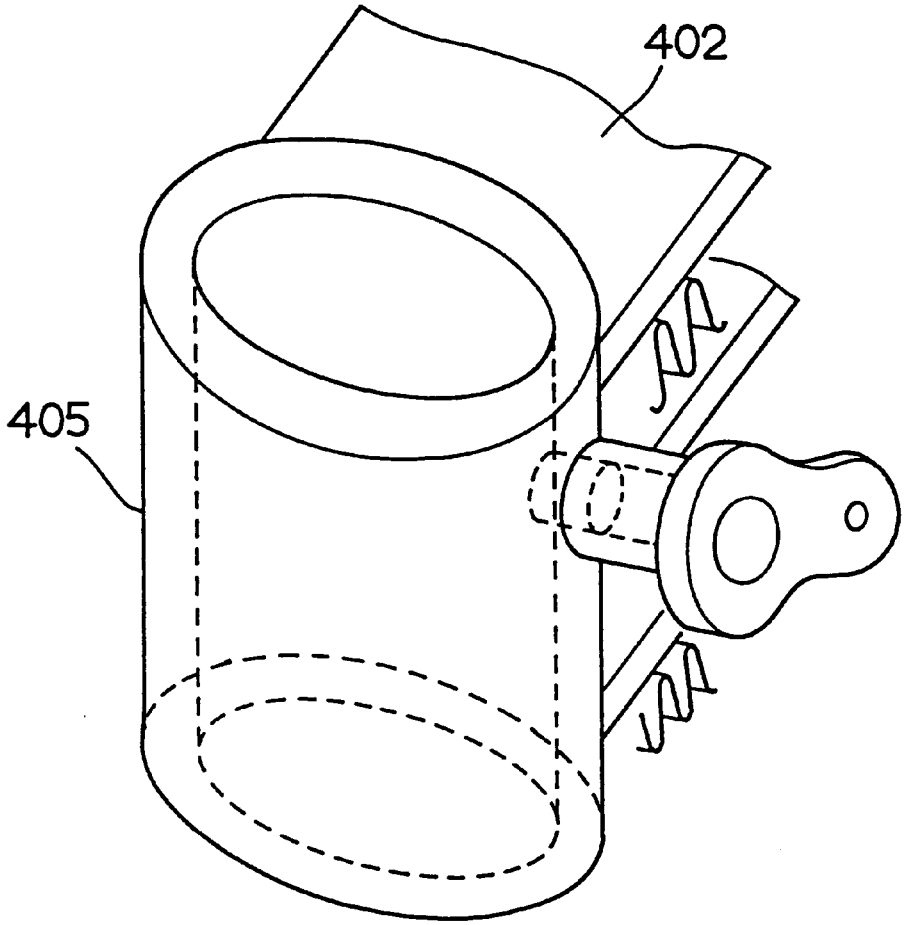
FIG. 39 PRIOR ART
FIG. 39 is a perspective view of a header tank of a conventional radiator.

Further, in the seventh through thirteenth embodiments, the header tank 205 is integrally formed through extrusion or drawing. However, as shown in FIG. 37, the header tank 205 may be formed by connecting a core plate 501 adjacent to the flat tubes 202 and a tank portion 502. The first and second spaces 205*a,* 205*b* are formed by the core plate 501 and the tank portion 502.

Although the present invention has been fully described in connection with preferred embodiments thereof with reference to the accompanying drawings, it is to be noted that various changes and modifications will become apparent to those skilled in the art.

Such changes and modifications are to be understood as being within the scope of the present invention as defined by the appended claims.

What is claimed is:

1. A heat exchanger comprising:

a plurality of tubes, each of said tubes including a first portion having a first wall portion for forming a plurality of first passages through which a fluid flows in a longitudinal direction of said first portion, and a second portion disposed on both sides of said first portion, said second portion having a second wall portion for forming a second passage in which no fluid flows; and a header tank connected to longitudinal ends of said tubes to communicate with said first passages, said header tank extending in a direction perpendicular to a longitudinal direction of said tubes, wherein:

each of longitudinal ends of said second portion is recessed from each of the longitudinal ends of said first portion; and said second wall portion has a wall thickness thinner than that of said first wall portion.

2. The heat exchanger according to claim 1, wherein said second passage has a sectional area larger than each sectional area of said first passages in a cross section perpendicular to said longitudinal direction of said tubes.

3. The heat exchanger according to claim 2, wherein:

each of said first passages has a round-shaped cross-section; and said second passage has a polygonal-shaped cross-section.

4. The heat exchanger according to claim 1, wherein each of said tubes is formed by extrusion.

5. The heat exchanger according to claim 1, wherein:

said second passage has a plurality of passage portions; and each of said passage portions of said second passage has a sectional area larger than each sectional area of said first passages in a cross section perpendicular to said longitudinal direction of said tubes.

6. The heat exchanger according to claim 1, further comprising:

an inner partition wall, disposed within said header tank and extending in a longitudinal direction of said header tank, for partitioning an inner space of said header tank into plural tank passages extending in said longitudinal direction of said header tank, wherein each of said tank passages of said header tank has a substantially-circular cross-section.

7. The heat exchanger according to claim 6, wherein said inner partition wall has a width dimension in a width direction perpendicular to both of said longitudinal direction of said tubes and said longitudinal direction of said header tank, and said width dimension of said inner partition wall gradually increases toward said inner walls of said header tank.

8. The heat exchanger according to claim 6, further comprising:

a separation member for separating said header tank into plural spaces in said longitudinal direction of said header tank, wherein said separation member is bonded to said inner walls of said header tank and said inner partition wall.

9. The heat exchanger according to claim 6, further comprising:

a separation member for separating said header tank into plural spaces in said longitudinal direction of said header tank, said separation member including plural circular plate portions, and a connection portion provided between said plate portions, for partially connecting said plate portions to each other, wherein said tank passages of said header tank are airtightly partitioned by said plate portions in said longitudinal direction of said header tank.

10. The heat exchanger according to claim 6, further comprising:

a cap connected to each of longitudinal ends of said header tank, for closing each of said longitudinal ends of said header tank, wherein:

said cap has a hemispherical recess portion being recessed in a substantially hemispherical shape, to which a pressure inside said header tank is applied.

11. The heat exchanger according to claim 6, wherein:

said header tank has a tank hole through which inside and outside of said header tank communicate with each other; and said inner partition wall closes said tank hole when said inner partition wall is brazed to said inner wall of said header tank.

12. The heat exchanger according to claim 11, further comprising:

a plurality of corrugated fins disposed between adjacent said tubes, wherein:

said inner partition wall has a protruding portion which penetrates through said tank hole and protrudes to an outside of said header tank; and said corrugated fins contact a protruding end of said protruding portion in such a manner that a predetermined gap is provided between said corrugated fins and said header tank.

13. The heat exchanger according to claim 12, wherein a part of said protruding portion is plastically deformed, when said inner partition wall and said header tank are connected.

14. The heat exchanger according to claim 6, wherein:

said header tank includes a first plate having a plurality of insertion holes into which said tubes are inserted, and a second plate connected to said first plate to form said tank passages through which said fluid flows;

said first plate has plural arc portions protruding toward said tubes and laterally connected to each other;

said first plate has a connection portion where said arc portions are connected to each other;

said second plate has a protruding portion which protrudes toward said first plate;

said connection portion of said first plate and a protruding end of said protruding portion of said second plate are connected to form said inner partition wall; and said tubes are inserted into said insertion holes to be connected to said header tank in such a manner that a gap is formed between said protruding end of said protruding portion of said second plate and each longitudinal end of said tubes.

15. The heat exchanger according to claim 1, further comprising:

an inner partition wall disposed within said header tank and extending in a longitudinal direction of said header tank, for partitioning an inner space of said header tank into plural tank passages extending in said longitudinal direction of said header tank, wherein:

said inner partition wall has a width dimension in a width direction perpendicular to both of said longitudinal direction of said tubes and said longitudinal direction of said header tank, said width dimension of said inner partition wall being gradually increased toward said inner walls of said header tank;

said inner partition wall has a communication path through which said tank passages of said header tank communicate with each other; and said communication path is positioned on a side adjacent to said tubes with respect to a position of said inner partition wall having a minimum width in the width direction.

16. The heat exchanger according to claim 15, wherein one longitudinal end of each tube has a recess portion being recessed toward the other longitudinal end of each tube.

17. The heat exchanger according to claim 6, wherein:

said header tank includes a first plate having a plurality of insertion holes into which said tubes are inserted, and a second plate connected to said first plate to form said tank passages through which said fluid flows, wherein each of said first and second plates is formed by pressing.

18. The heat exchanger according to claim 1, further comprising:

an inner partition wall disposed within said header tank and extending in a longitudinal direction of said header tank, for partitioning said header tank into first and second tank passages extending in said longitudinal direction of said header tank, wherein:

said header tank is connected to said tubes in such a manner that said first and second tank passages communicate with said tubes; and said first and second tank passages are provided in such a manner that an amount of said fluid flowing through said first tank passage becomes larger than an amount of said fluid flowing through said second tank passage.

19. The heat exchanger according to claim 18, wherein:

said header tank includes a first tank portion extending in a direction perpendicular to said longitudinal direction of said tubes, for distributing said fluid into said tubes, and a second tank portion extending in a direction perpendicular to said longitudinal direction of said tubes, into which said fluid having flowing through said tubes is collected;

said inner partition wall is disposed within said first tank portion; and said first tank passage is provided at an upstream air side of said second tank passage relative to a flow direction of air passing through between said tubes.

20. The heat exchanger according to claim 19, wherein said inner partition wall has a first communication hole through which said first and second tank passages communicate with each other.

21. The heat exchanger according to claim 20, further comprising:

a pipe connected to said header tank, through which said fluid is introduced into said header tank, wherein:

said first tank portion has a second communication hole at a position corresponding to said first tank passage, said first tank passage and said pipe communicating with each other through said second communication hole; and said first communication hole has an opening area smaller than that of said second communication hole.

22. The heat exchanger according to claim 21, wherein said second communication hole includes plural holes communicating with said pipe.

23. The heat exchanger according to claim 21, wherein said pipe has plural passages extending in a longitudinal direction of said pipe, through which said fluid flows.

24. The heat exchanger according to claim 1, further comprising:

an inner partition wall disposed within said header tank and extending in a longitudinal direction of said header tank, for partitioning said header tank into first and second tank passages extending in said header tank; and a pipe for introducing said fluid into said header tank, said pipe penetrating through said first tank passage and said inner partition wall to extend to said second tank passage, wherein:

said header tank is connected to said tubes in such a manner that said first and second tank passages communicate with said tubes;

said header tank includes a first tank portion extending in a direction perpendicular to said longitudinal direction of said tubes, for distributing said fluid into said tubes, and a second tank portion extending in a direction perpendicular to said longitudinal direction of said tubes, into which said fluid having flowing through said tubes is collected;

said inner partition wall is disposed inside said first tank portion;

said first tank passage is provided at an upstream air side of said second tank passage relative to a flow direction of air passing through between said tubes;

said pipe includes a first opening opened in said first tank passage, and a second opening opened in said second tank passage; and said second opening has an opening area smaller than that of said first opening.

25. The heat exchanger according to claim 24, wherein said pipe has plural passages extending in a longitudinal direction of said pipe, through which said fluid flows.

26. The heat exchanger according to claim 1, further comprising:

an inner partition wall disposed within said header tank and extending in a longitudinal direction of said header tank, for partitioning said header tank into first and second tank passages extending in said header tank; and a fluid supplying member for introducing said fluid into said first and second tank passages of said header tank, wherein:

said header tank is connected to said tubes in such a manner that said first and second tank passages communicate with said tubes;

said header tank includes a first tank portion extending in a direction perpendicular to said longitudinal direction of said tubes, for distributing said fluid into said tubes, and a second tank portion extending in a direction perpendicular to said longitudinal direction of said tubes, into which said fluid having flowing through said tubes is collected;

said inner partition wall is disposed within said first tank portion;

said first tank passage is provided at an upstream air side of said second tank passage relative to a flow direction of air passing through between said tubes; and said fluid supplying member is provided in such a manner that an amount of said fluid flowing into said first tank passage is larger than that of said fluid flowing into said second tank passage.

27. A heat exchanger according to claim 26, wherein said fluid supplying member respectively supplies said fluid into said first and second tank passages.

* * * * *